US006273413B1

(12) United States Patent
Graef

(10) Patent No.: US 6,273,413 B1
(45) Date of Patent: Aug. 14, 2001

(54) AUTOMATED BANKING MACHINE WITH SHEET DIRECTING APPARATUS

(75) Inventor: H. Thomas Graef, Bolivar, OH (US)

(73) Assignee: Diebold, Incorporated, North Canton, OH (US)

( * ) Notice: Subject to any disclaimer, the term of this patent is extended or adjusted under 35 U.S.C. 154(b) by 0 days.

(21) Appl. No.: 08/980,467

(22) Filed: Nov. 28, 1997

(51) Int. Cl.[7] ..... B65H 5/22

(52) U.S. Cl. ..... 271/3.14; 221/21; 271/3.19; 271/6; 271/9.11; 271/9.18; 271/185; 902/8; 270/58.33; 270/58.01; 270/59

(58) Field of Search ..... 209/534; 271/3.01, 271/3.14, 3.18, 3.19, 4.01, 6, 7, 9.01, 9.11, 9.12, 9.13, 298, 69, 185, 9.08, 216, 3.05, 3.08, 280; 221/21; 902/8, 14, 15

(56) References Cited

U.S. PATENT DOCUMENTS

| | | | | |
|---|---|---|---|---|
| 3,955,812 | | 5/1976 | Suda et al. . | |
| 3,979,112 | * | 9/1976 | Munn et al. | 270/58 |
| 4,095,781 | * | 6/1978 | Kistner et al. | 221/21 |
| 4,179,031 | * | 12/1979 | Ward | 209/534 |
| 4,266,761 | * | 5/1981 | Buck | 270/58 |
| 4,363,584 | * | 12/1982 | Kokubo | 271/212 |
| 4,494,747 | * | 1/1985 | Graef et al. | 271/263 |
| 4,569,513 | * | 2/1986 | Backman | 271/280 |
| 4,747,493 | * | 5/1988 | Nakanishi | 209/534 |
| 4,871,085 | * | 10/1989 | Graef et al. | 221/4 |
| 4,928,230 | * | 5/1990 | Kawamura et al. | 221/271 |
| 5,083,769 | * | 1/1992 | Young | 271/280 |
| 5,342,165 | * | 8/1994 | Graef et al. | 414/788.9 |
| 5,346,206 | * | 9/1994 | Steinhart | 271/216 |
| 5,503,387 | * | 4/1996 | Straessler et al. | 271/280 |
| 5,534,682 | * | 7/1996 | Graef et al. | 235/379 |
| 5,797,599 | * | 8/1998 | Meyer et al. | 271/272 |
| 5,876,029 | * | 3/1999 | Wright et al. | 271/3.18 |
| 5,913,656 | * | 6/1999 | Collins | 271/9.01 |
| 5,960,963 | * | 10/1999 | Chodack et al. | 271/185 |
| 6,213,457 | * | 4/2001 | Schlough | 270/58 |

FOREIGN PATENT DOCUMENTS

| | | | | |
|---|---|---|---|---|
| 441368 | * | 12/1992 | (JP) | 271/280 |

* cited by examiner

*Primary Examiner*—Christopher P. Ellis
*Assistant Examiner*—Joe Dillon, Jr.
(74) *Attorney, Agent, or Firm*—Ralph E. Jocke; Daniel D Wasil; Walker & Jocke

(57) ABSTRACT

An automated banking machine (10) includes a user interface (12) including an opening (20) for users to deliver and receive individual sheets and stacks of sheets to and from the machine. The machine includes a sheet handling mechanism therein including a first transport path (46) and a second transport path (42). Various devices for dispensing and receiving sheets (30, 32, 34, 36, 38, 40) are positioned adjacent to the second transport path and dispense and/or receive sheets therefrom. The second transport path meets the first transport path at an intersection (60). The machine includes control circuitry (44) which controls the dispensing and movement of sheets along the sheet paths in response to inputs by customers. A sheet directing apparatus (110) is positioned adjacent to the intersection (60). The sheet directing apparatus (110) is selectively operative as a stack of sheets moves through the intersection to either add a sheet to the stack or to separate a sheet from the stack.

44 Claims, 22 Drawing Sheets

AUTOMATED BANKING MACHINE WITH SHEET DIRECTING APPARATUS

TECHNICAL FIELD

This invention relates to automated banking machines. Specifically, this invention relates to an automated banking machine which delivers and receives various types of sheet materials through a single opening in the machine.

BACKGROUND ART

Automated banking machines are known in the prior art. A common type of automated banking machine is an automated teller machine (ATM). ATMs are commonly used by individuals to receive cash from their accounts, to pay bills, to transfer cash between accounts, and to make deposits. Certain ATMs also enable customers to deposit checks, money orders, travelers checks, or other instruments. Such ATMs sometimes have the capability of creating an electronic image of a deposited instrument.

ATMs also commonly provide various types of sheets to customers. Such sheets include currency bills that customers withdraw from the machine. Customers may also receive sheet materials such as money orders, bank checks, scrip, stamps or other sheet materials stored in or produced by the machine. Customers also commonly receive from an ATM a printed sheet which is a receipt indicating the particulars of the transactions they have conducted at the machine. In addition customers may request and receive from some ATMs a more detailed statement of transactions conducted on their account.

ATMs currently in use often have several different locations on the machine where sheets are received from or delivered to a customer. For example, most machines include one area for delivering cash to a customer and another area for receiving deposits. More than one deposit receiving area may also be provided for different types of deposits. For example, an ATM may have one opening for receiving envelope deposits, and a separate opening for receiving negotiable instruments, such as checks. ATMs also typically have a particular area for delivering receipts to the customer. If the machine has the capability of printing a complete account statement on larger paper an additional area may be provided where statement sheets are delivered.

Having different areas on the customer interface of an ATM to receive and provide different types of sheets is required because each type of sheet is processed by a different mechanism within the machine. Each of these mechanisms has its own separate access to the customer. This makes machines with different features substantially different from other machines and adds complexity to their operation. Providing several different passageways and transports for receiving and providing sheet materials to customers also adds complexity and cost to a machine.

While the drawbacks associated with multiple sheet delivery and receiving openings is easily appreciated with regard to ATMs, other automated banking machines have similar drawbacks. For example the machines used by bank tellers to count currency received from customers are generally totally different machines than those used to dispense currency that is to be provided by the teller to a customer. Separate machines are also provided for receiving and imaging checks and other types of negotiable instruments and documents of value. Often a separate terminal is provided to print a record of a transaction for a customer. The drawbacks associated with having different machine interfaces to receive and deliver documents is common to automated banking machines other than ATMs. Thus there exists a need for an automated banking machine that has a simpler user interface, and which is capable of receiving as well as providing various types of sheets. through a single opening.

DISCLOSURE OF INVENTION

It is an object of the present invention to provide an automated banking machine.

It is a further object of the present invention to provide an automated banking machine which has a simpler customer interface.

It is a further object of the present invention to provide an automated banking machine which has a single opening for receiving and providing various types of sheets and documents.

It is a further object of the present invention to provide an automated banking machine which performs a plurality of banking transaction functions and which has a compact physical size.

It is a further object of the present invention to provide an automated banking machine that may be more readily configured to provide different banking functions.

It is a further object of the present invention to provide an automated banking machine that is economical to manufacture and operate.

It is a further object of the present invention to provide an automated banking machine that accepts and delivers various types of banking documents in a stack from and to customers, respectively.

It is a further object of the present invention to provide an automated banking machine that enables selectively removing sheets from a stack.

It is a further object of the present invention to provide an automated banking machine that enables selectively assembling document sheets into a stack.

It is a further object of the present invention to provide a method for operation of an automated banking machine in which sheets are selectively removed from a stack by transporting the stack in a first transport path through an intersection with a second transport path, in which a sheet directing apparatus adjacent to the intersection selectively separates sheets from the stack.

It is a further object of the present invention to provide a method for operation of an automated banking machine in which a sheet moving in a first transport path and a sheet moving in a second transport path are brought together in aligned relation to form a stack, as the sheets pass through an intersection of the first and second transport paths.

Further objects of the present invention will remain apparent in the following Best Modes for Carrying Out Invention and the appended claims.

The foregoing objects are accomplished in a preferred embodiment of the present invention by an automated banking machine having a transport which moves sheets or stacks of sheets along a first transport path. The first transport path extends from a user accessible opening on an interface of the machine. The machine also includes an internal second transport path for transporting sheets. The second transport path meets the first transport path at an intersection. A sheet directing apparatus is positioned adjacent to the intersection.

The machine further includes at least one sheet dispensing device and at least one sheet accepting device for dispensing and receiving sheets, respectively. The sheet dispensing and receiving devices are in operative connection with either the first or second transport paths.

In operation of the machine a stack of sheets received from a user is moved from the opening along the first transport path. As the stack passes the intersection the sheet directing apparatus is selectively operative to separate a sheet from the stack and direct the sheet into the second transport path. Once in the second transport path the separated sheet may be handled individually for processing or storage in the machine. Passing the stack through the intersection enables selectively removing sheets from the stack in response to operation of the sheet directing apparatus.

Sheets dispensed or otherwise held in the machine are enabled to be assembled into a stack by moving a sheet in the first transport path. A sheet in the second transport path is moved to the intersection in coordinated relation with the first sheet. The first and second sheets engage in aligned relation and form a stack in the first transport path as the sheets move through the intersection. Additional sheets are selectively added to the stack as the stack is thereafter again moved through the intersection while successive sheets are brought to the intersection through the second transport path. Various types of sheets are selectively assembled into the stack in the operation of the machine. Control circuitry operates the components of the machine to assemble the stack. Once the stack is assembled, it is delivered to the user by passing it along the first transport path to the user opening.

BEST MODES FOR CARRYING OUT INVENTION

Figure 1:
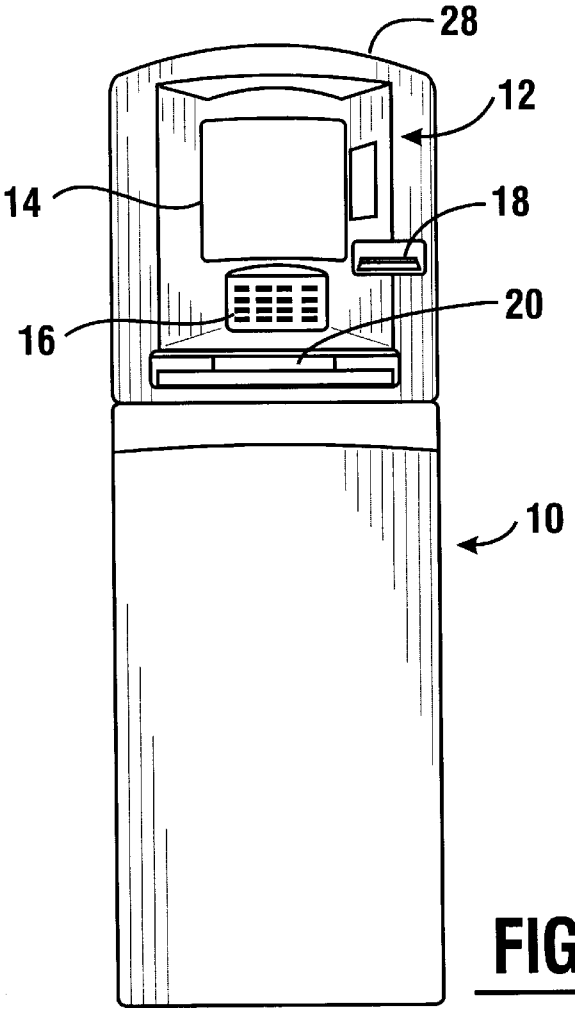
FIG. 1 is a front plan view of an automated banking machine of the described embodiment of the present invention.

Referring now to the drawings, and particularly to FIG. 1, there is shown therein an automated banking machine generally indicated 10. Machine 10 is an ATM, however other embodiments of the invention may be other types of automated banking machines. ATM 10 includes a user or customer interface generally indicated 12. Customer interface 12 includes a touch screen 14. Touch screen 14 is of a type known in the prior art which serves as both an input device and an output device. The touch screen enables outputs through displays on the screen and enables customers to provide inputs by placing a finger adjacent to areas of the screen.

Customer interface 12 further includes a keypad 16. Keypad 16 includes a plurality of buttons which may be actuated by a customer to provide inputs to the machine. Customer interface 12 further includes a card reader slot 18. Card slot 18 is used to input a card with encoded data thereon that identifies the customer and/or the customer's account information. Card slot 18 is connected to a card reader of a conventional type for reading data encoded on the card.

Customer interface 12 further includes an opening 20. Opening 20 as later explained, is used to receive stacks of sheets or documents from a customer operating machine 10. Opening 20 is also used to deliver stacks of documents to customers operating the machine. Although opening 20 is shown exposed in FIG. 1, it should be understood that in other embodiments it may be selectively covered by a movable gate or similar closure structure.

Figure 2:
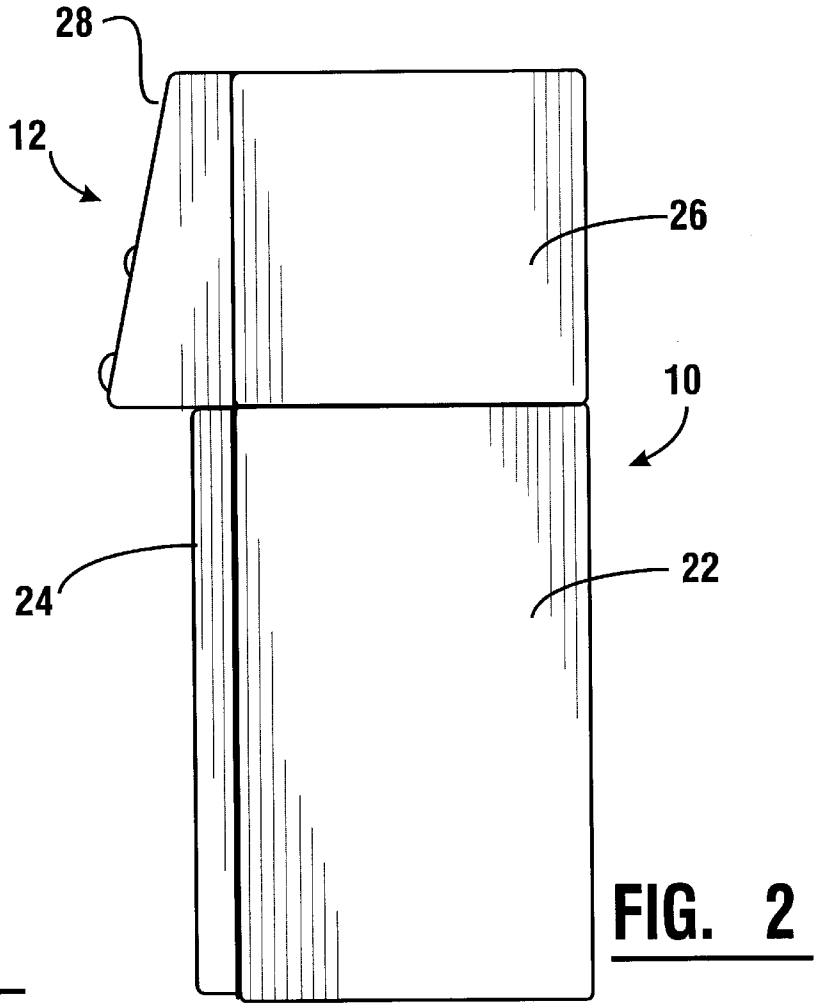
FIG. 2 is a left side view of the automated banking machine shown in FIG. 1.

As shown in FIG. 2 machine 10 has a generally divided body structure which includes a chest portion 22. Chest portion 22 is preferably a secure chest and is used for holding items of value such as currency or deposits. Chest portion 22 has a door 24 which can be selectively opened to gain access to the interior of the chest portion. Door 24 preferably includes a combination lock or other locking mechanism (not shown) which prevents the chest portion from being opened by unauthorized persons.

Machine 10 further includes an upper enclosure portion 26. The upper enclosure portion has the customer interface 12 thereon. The customer interface portion 12 includes a fascia 28. Fascia 28 is preferably movably mounted on the upper enclosure portion 26 and may be selectively opened to gain access to components housed in the upper enclosure portion. A locking mechanism (not shown) is preferably included in the upper enclosure portion for preventing unauthorized persons from gaining access to the interior thereof.

Figure 3:
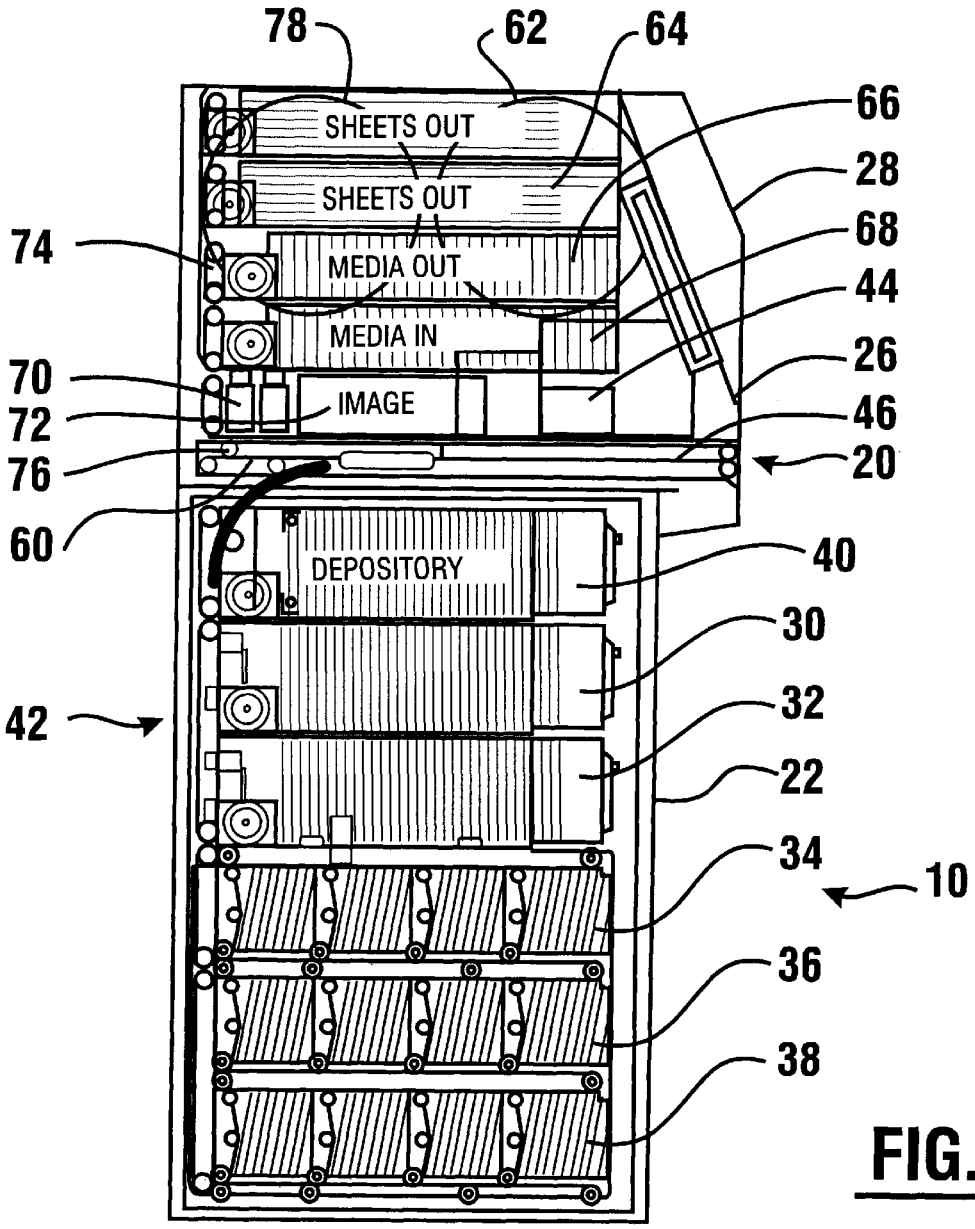
FIG. 3 is a schematic cross sectional view of the automated banking machine shown in FIG. 1.

As shown in FIG. 3 machine 10 includes a plurality of devices for carrying out banking transactions. It should be understood that the devices discussed hereafter are exemplary and that additional or different devices may be included in other embodiments of the invention.

The interior of ATM 10 is schematically shown in FIG. 3. The ATM includes several sheet dispensing devices and sheet receiving devices. Among the sheet dispensing devices are currency dispensers 30 and 32. Currency dispensers 30 and 32 are preferably of the type shown in U.S. Pat. No. 4,494,747, which selectively dispense sheets one at a time in response to control signals. Currency dispensers 30 and 32 preferably include removable sheet holding containers or canisters which include indicia thereon. The canisters are preferably interchangeable and of the type shown in U.S. Pat. No. 4,871,085. The indicia on the sheet holding canisters is preferably indicative of the type and/or properties of sheets held therein (i.e. currency type and denomination) and the indicia is read by a reading apparatus when the canister is installed in the machine.

The ATM operates in response to the indicia on the canisters to adjust the operation of the dispensers to conform to the canister contents and position. In the preferred embodiment of the invention the sheet holding canisters and other devices, preferably include indicia of the type shown in U.S. Pat. No. 4,871,085. The information represented by the indicia is read by the reading apparatus and the resulting signals transmitted to the machine control circuitry. The control circuitry adjusts operation of the sheet dispensing and receiving devices in response to the signals to conform to the type and character of the sheets held in the various canisters.

In the exemplary embodiment of machine 10 shown in FIG. 3, the machine preferably includes sheet receiving and delivering devices 34, 36 and 38. The sheet delivering and receiving devices enable receiving and storing sheets in selected compartments as well as selectively delivering sheets from the various compartments. Machine 10 further includes an envelope depository schematically indicated 40. Depository 40 is a device configured to accept and hold relatively thick sheet like deposit envelopes deposited by customers in the machine.

Depository 40, currency dispensers 30 and 32 and sheet receiving and delivering devices 34, 36 and 38 are all positioned within the chest portion 22 of the machine 10. In the preferred embodiment, the sheet dispensing and receiving devices, except for the depository, may be interchangeably positioned in the machine. The control circuitry adjusts operation of the machine accordingly based on the device positions and the indicia on the canisters or devices.

Each of the currency dispensers 30 and 32, sheet receiving and delivering devices 34, 36 and 38, and the depository 40 are in communication with a sheet transport path generally indicated 42. Sheet transport path 42 comprises a plurality of sheet transports which are aligned and in operative connection through a rear area of the chest portion. Sheet transport path 42 preferably includes one or more sheet transports of the type shown in U.S. Pat. No. 5,240,368. Each of the depository 40, currency dispensers 30 and 32 and sheet receiving and delivering devices 34, 36 and 38 are in operative connection with the sheet transport path 42, and are enabled to deliver sheets to and/or receive sheets from the sheet transport path 42.

Sheet transport path 42 extends through an opening (not shown) in the chest portion 22 of the ATM chest. Wiring that connects components located in the chest portion with components in the upper enclosure portion 26 also extends through an opening in the chest portion and is connected to control circuitry, schematically indicated 44. The control circuitry 44 preferably includes at least one processor in operative connection with a memory, and carries out programmed instructions based on data stored in the memory. The control circuitry operates the machine to carry out the operations hereinafter described.

Upper enclosure portion 26 includes the fascia 28 and the customer accessible opening 20. A first transport path generally indicated 46 extends inside the machine from opening 20. First transport path 46 preferably includes an interwoven belt type transport of the type shown in co-pending U.S. patent application Ser. No. 08/813,134 filed Mar. 7 1997, now U.S. Pat. No. 5,797,599, the disclosure of which is incorporated by reference as if fully rewritten herein. A transport of this type is schematically shown in FIG. 5 and is generally indicated 48.

Transport 48 includes a plurality of spaced first rolls 50 and a plurality of intermediate spaced second rolls 52. Rolls 50 and 52, which are preferably crowned rolls, support elastomeric belts thereon. First rolls 50 support first belts 54, second rolls 52 support second belts 56. Belts 54 and 56 extend longitudinally in the transport 48.

Figure 5:
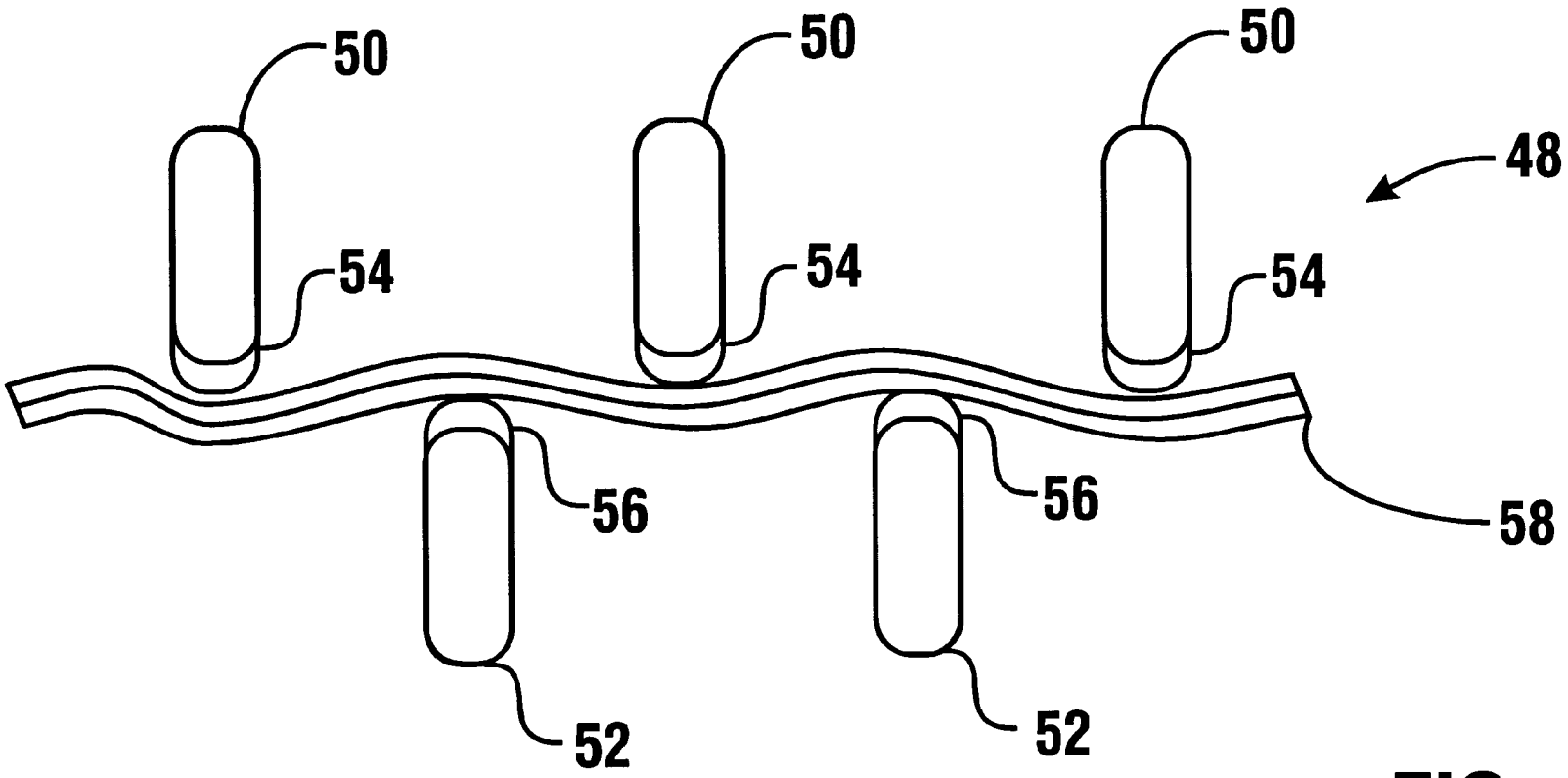
FIG. 5 is a transverse cross sectional view of a transport used in the automated banking machine.

A stack of sheets schematically represented by sheet 58 in FIG. 5, move in engaged relation with belts 54 and 56 in the transport as described in U.S. patent application Ser. No. 08/813,134 now U.S. Pat. No. 5,797,599. The configuration of transport 48 enables transporting stacks having varied numbers of sheets, as well as transporting passbooks and other forms of stacked sheets. The transport of the preferred embodiment is particularly useful because of its ability to transport sheets of various types, having varied thicknesses arid frictional properties while minimizing skewing.

Referring again to FIG. 3, first transport path 46 intersects with transport path 42 at a first intersection, generally indicated 60. As hereinafter explained sheets are selectively stacked and unstacked while moving through first intersection 60 to enable processing of sheets within the machine 10.

Upper enclosure portion 26 also includes various sheet dispensing and receiving devices. These dispensing and receiving devices preferably include dispensers similar to those shown in U.S. Pat. No. 4,494,747 and include removable canisters for holding sheets therein. Such removable canisters may also include indicia of the type described in U.S. Pat. No. 4,871,085, which are read by apparatus within the machine. The control circuitry is operative to control the operation of the machine in response to the indicia.

Sheet dispensing devices 62 and 64 preferably hold sheets such as blank receipt or statement forms. Alternatively, one of such canisters may hold instruments which must be completed, such as scrip forms or travelers checks. A further sheet dispensing device 66 may dispense bank checks or plates of stamps.

A sheet receiving device 68 is also preferably included in the upper enclosure portion. Sheet receiving device 68 may be used for holding sheets such as checks, which have been input by a customer to the machine and which have been imaged and/or canceled through processing in the machine.

The upper enclosure portion further includes a printing device schematically indicated 70. Printing device 70 is used for selectively printing on sheets under control of the control circuitry. An imaging device schematically indicated 72 is also included. Imaging device 72 is preferably of the type which enables reading and generating an electronic image of a document, such as that shown in U.S. Pat. No. 5,534,682.

The sheet dispensing devices 62, 64 and 66, as well as the sheet receiving device 68, are all in communication with one or more transports. These transports are preferably of the type shown in U.S. Pat. No. 5,342,165, or other suitable sheet transport devices. The sheet transport devices form a sheet transport path 74. Sheet transport path 74 extends to transport path 46 and meets transport path 46 at a second intersection 76.

The upper enclosure portion may also include additional or other devices. Such devices may include a journal printer as schematically indicated by rolls 78. The journal printer is used to make a paper record of transactions conducted at machine 10. Electronic journals may also be made by the control circuitry and stored in memory. Other devices which may be included in the machine are audio output devices, customer sensors, cameras and recorders, and other apparatus suitable for use in the operation of the particular type of automated banking machine.

Figure 4:
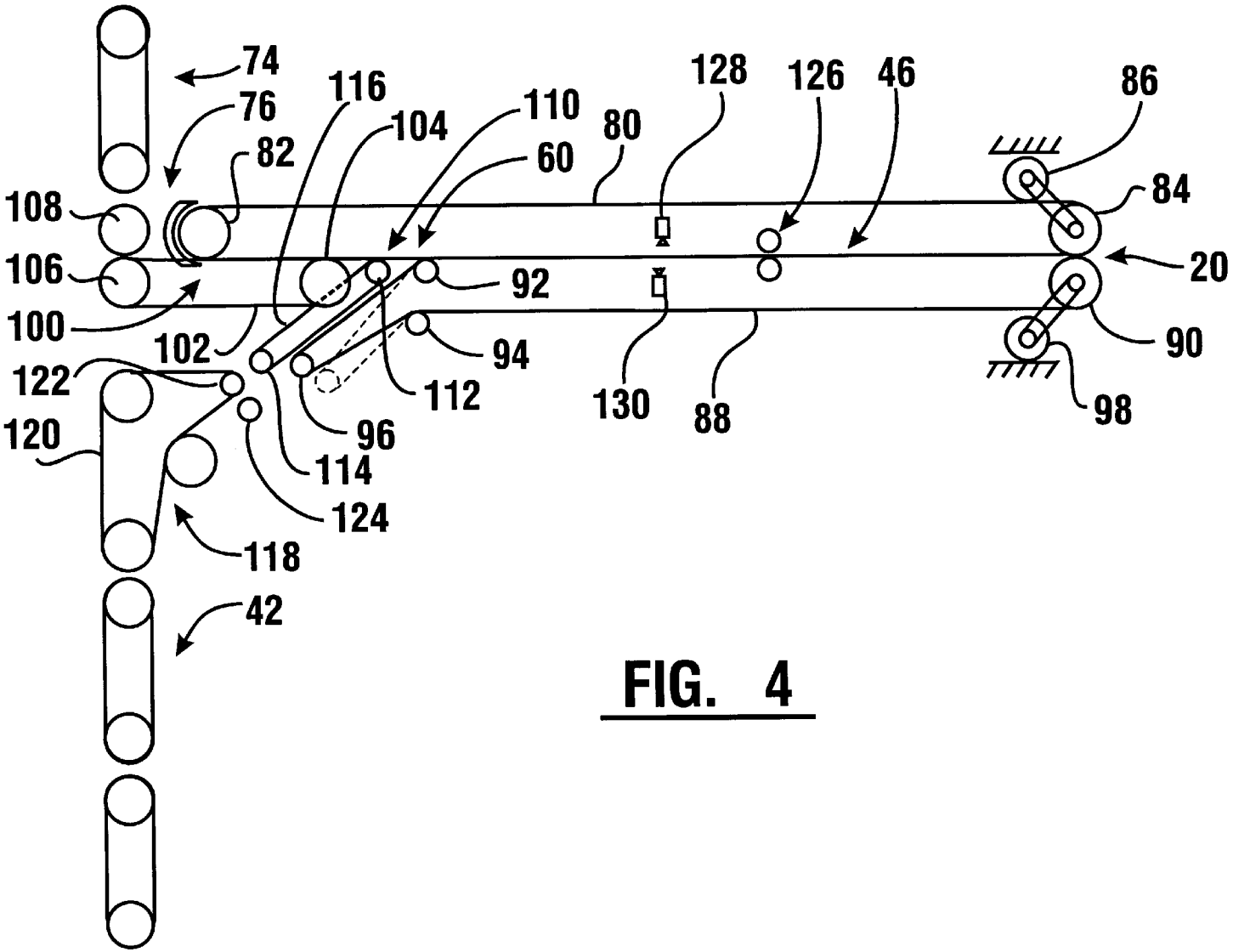
FIG. 4 is a side schematic view of a first transport path and a second transport path in the automated banking machine.

Transport paths 42, 46 and 74 are shown in greater detail in FIG. 4. Transport path 46, which includes one or more transports of the interwoven belt type shown in FIG. 5. The transport path has therein a plurality of first belts 80 which extend between first rolls 82 and 84. First rolls 82 and 84 are selectively driven by a reversible drive, schematically indicated 86.

Second belts 88 extend between a second roll 90 and rolls 92, 94 and 96. Second belts 88 are driven by a second reversible drive schematically indicated 98. As shown in FIG. 4, roll 96 is selectively movable for purposes which are later explained. Of course it should be understood that the belts and rolls shown in the first transport path 46 are actually a plurality of spaced belts and rolls of the type shown in FIG. 5.

First transport path 46 further includes a further transport section 100. Transport section 100 is similar to the transport shown in FIG. 5 and includes a plurality of third belts 102 journaled on spaced rolls 104 and 106.

Rolls 106 have positioned adjacent thereto a plurality of holding rolls 108. Rolls 108 are positioned in spaced axial intermediate relation of third belts 102. This configuration imparts a wave configuration to sheets and stacks of sheets in a manner comparable to that imparted to sheets held by transport 48 as shown in FIG. 5. Holding rolls 108 and transport section 100 are independently driven by reversible drives (not shown) under the control of the control circuitry 44.

Adjacent to first intersection 60, where sheet path 42 meets sheet path 46, is a sheet directing apparatus generally indicated 110. Sheet directing apparatus 110 includes sheet engaging rolls 112 and further rolls 114. Rolls 112 and 114 have resilient belts 116 mounted thereon. It should be understood that rolls 112 and 114 are driven by an independent reversible drive (not shown) under control of the control circuitry 44. It should be understood that rolls 112 and 114 and belts 116 in FIG. 4, represent a plurality of such belts and rolls which are preferably disposed in intermediate relation between the lower flights of first belts 80.

Transport path 42 further includes transport 118 which is adjacent to depository 40. Transport 118 includes a plurality of rolls which drive belts 120 in response to a reversing drive (not shown). Rolls 122 which are engaged with belts 120, as well as rolls 124 which are independently driven by a reversible drive (not shown), are positioned in the sheet path 42 adjacent to rolls 114 and 96. The purpose of this configuration is later discussed in detail.

As schematically represented in FIG. 4 transport path 46 includes sensing devices. These sensing devices are in operative connection with the control circuitry 44, and operate to sense features of sheets and stacks of sheets in the sheet transport path. A thickness sensor schematically indicated 126 is preferably provided for sensing the thickness of sheets, stacks of sheets, or sheet like deposit envelopes that move along transport path 46. Indicia reading devices 128 and 130 are preferably operative to sense indicia on sheets and envelopes moving in the transport path. The sensing devices may include photo reflective devices, magnetic sensing devices or other appropriate devices for distinguishing currency, various types of negotiable instruments and deposit envelopes. The particular type and position of the sensing devices used in a particular machine will depend on the characteristics and types of documents which are intended to be processed by the machine.

Various sheet manipulating and processing operations performed by the automated banking machine of the described embodiment are now explained in detail with reference to FIGS. 6–21.

Figure 6:
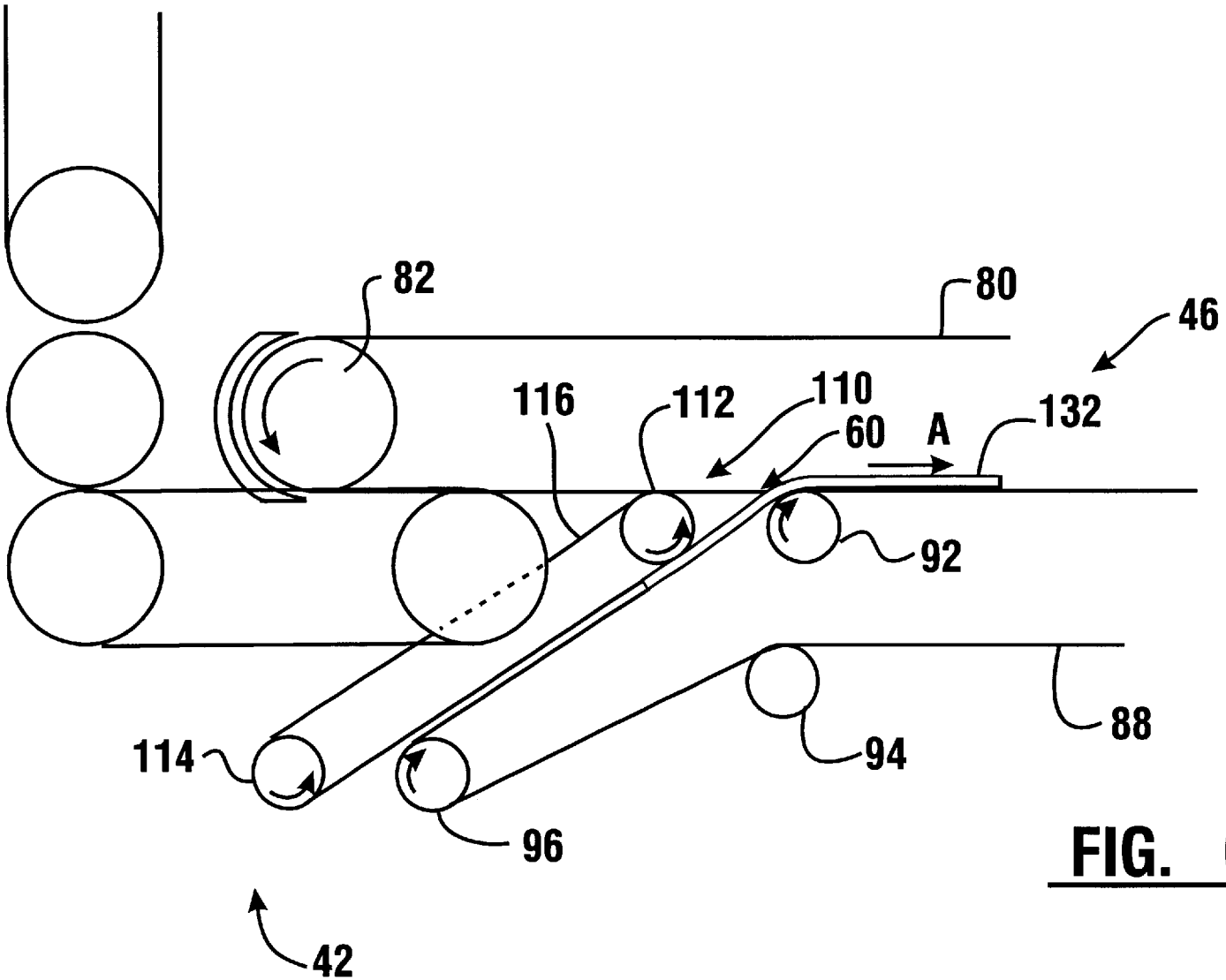
FIG. 6 is a schematic side view of a sheet moving from the second transport path to the first transport path through an intersection.

FIG. 6 shows a sheet 132 moving through the intersection 60 of the first sheet path 46 and sheet path 42. Sheet 132, prior to reaching the position shown in FIG. 6, may have been dispensed by one of the sheet dispensing devices positioned adjacent to transport path 42 and moved adjacent to the intersection by the transports which make up the transport path. As sheet 132 approaches the intersection it is engaged by belts 116 of the sheet directing apparatus 110, as well as belts 88. The control circuitry operates the drives which move the belts to work in cooperating relation to move the sheet toward the intersection. Once the sheet is passed through the intersection it is engaged between the lower flights of belt 80 and the upper flights of belts 88, and the sheet 132 is carried in the first direction indicated by Arrow A in FIG. 6. As will be appreciated from FIG. 4, Arrow A is in the direction of the customer opening 20 of the automated banking machine.

Figure 7:
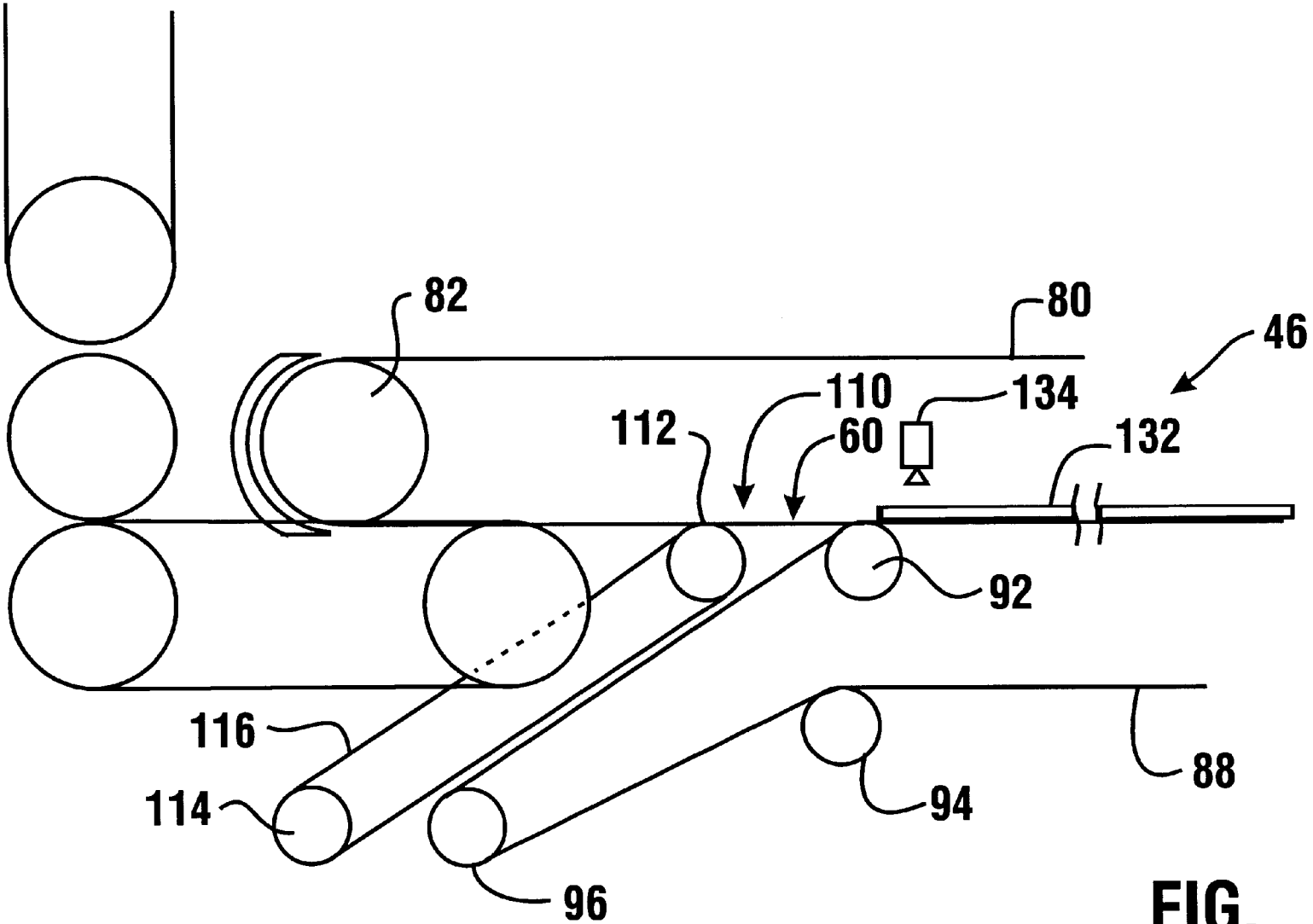
FIG. 7 is a view similar to FIG. 6 with the sheet moved into the first transport path from the intersection.

As shown in FIG. 7 in the mode of operation currently being described, once sheet 132 is fully moved through the intersection in the first transport path 146, movement of the sheet in the first direction is stopped. This is accomplished by the control circuitry 44 operating the transport drives in accordance with its program logic stored in memory, and in response to customer inputs at the customer interface. A sensor schematically indicated 134 positioned in the first sheet path senses the position of the sheet. Sensor 134 is in operative connection with the control circuitry. Sensor 134 position may be one of several types of sensors suitable for sensing the position of sheets, such as a photo reflective type sensor. Once sheet 132 is in the position shown in FIG. 7, belts 80 and 88 are stopped.

Figure 8:
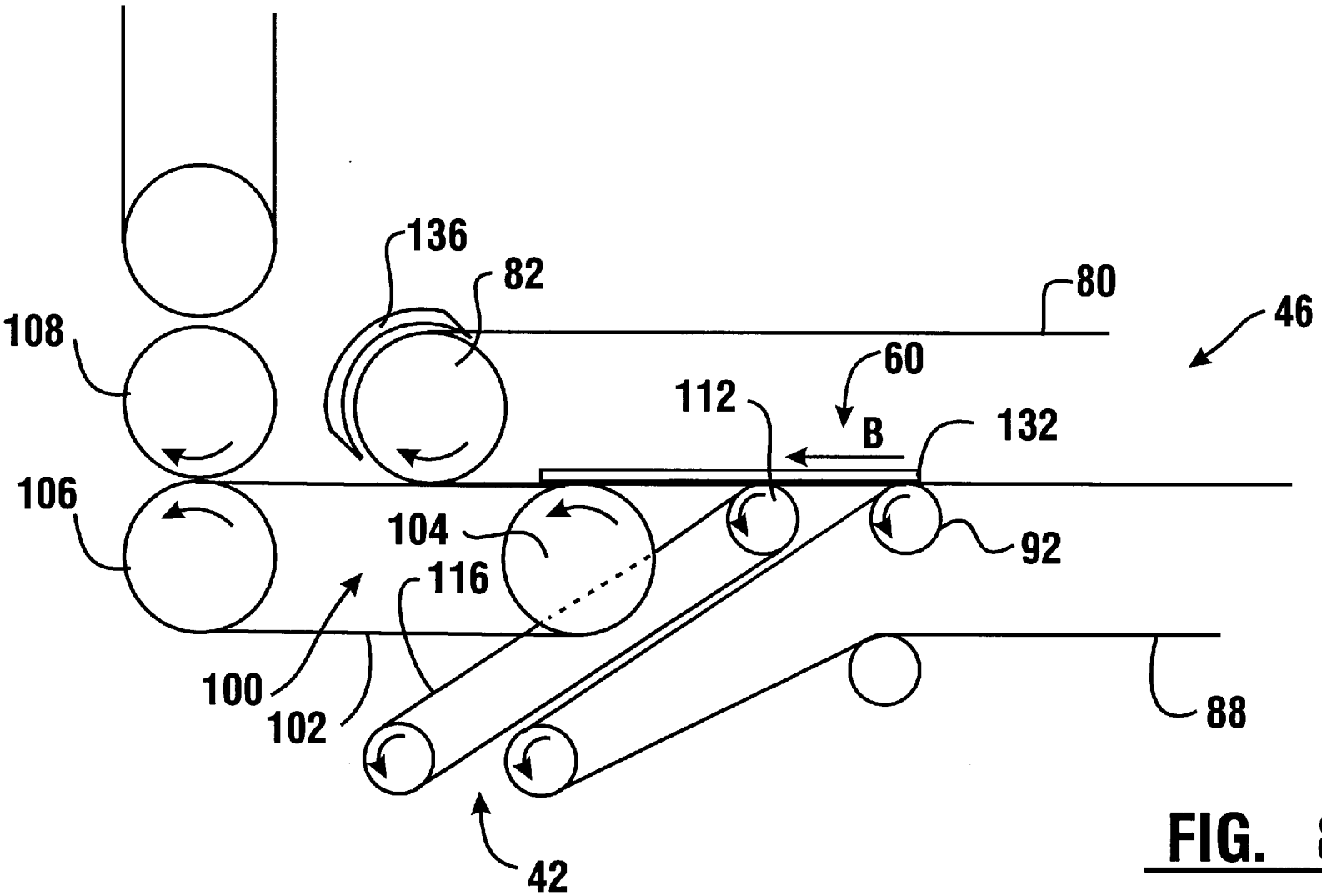
FIG. 8 is a schematic view similar to FIG. 7 with the sheet moving in an opposed direction through the intersection.

As shown in FIG. 8, the control circuitry now operate, the components of the machine to move sheet 132 in a second opposed direction as indicated by Arrow B. To move sheet 132 through the intersection in the opposed direction, sheet engaging rolls 112 and belts 116 rotate to prevent sheet 132 from passing into the second sheet transport path 42. Transport section 100 is also operated by the control circuitry to engage sheet 132 and move it in the opposed direction. A sheet turnover member 136 later described in detail, is moved to enable sheet 132 to pass roll 82 in the first sheet path.

Figure 9:
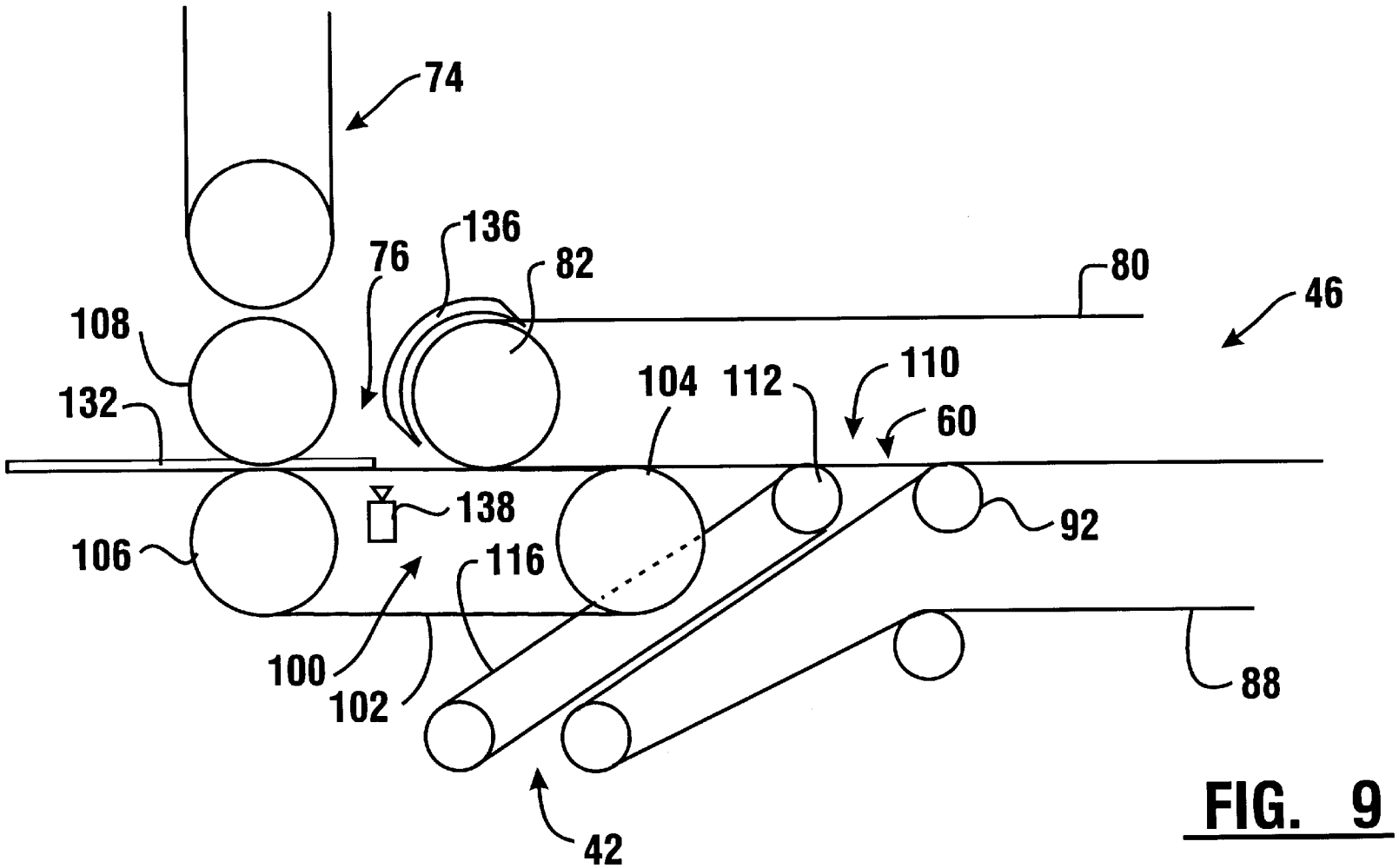
FIG. 9 is a schematic view similar to FIG. 8 with the sheet held in a holding device.

As shown in FIG. 9 sheet 132 is moved in the second direction until it is engaged between holding rolls 108 and transport section 100. A sensor which is schematically indicated 138 is positioned to sense that sheet 132 is positioned in the holding device provided by the combination of holding rolls 108 and transport section 100. Sensor 138 is operatively connected to the control circuitry which operates to stop further movement of sheet 132 in the second direction when it has reached the position shown. It should be noted that sheet 132 in this position is held adjacent to second intersection 76, which is the intersection of sheet path 74 and sheet path 46.

Figure 10:
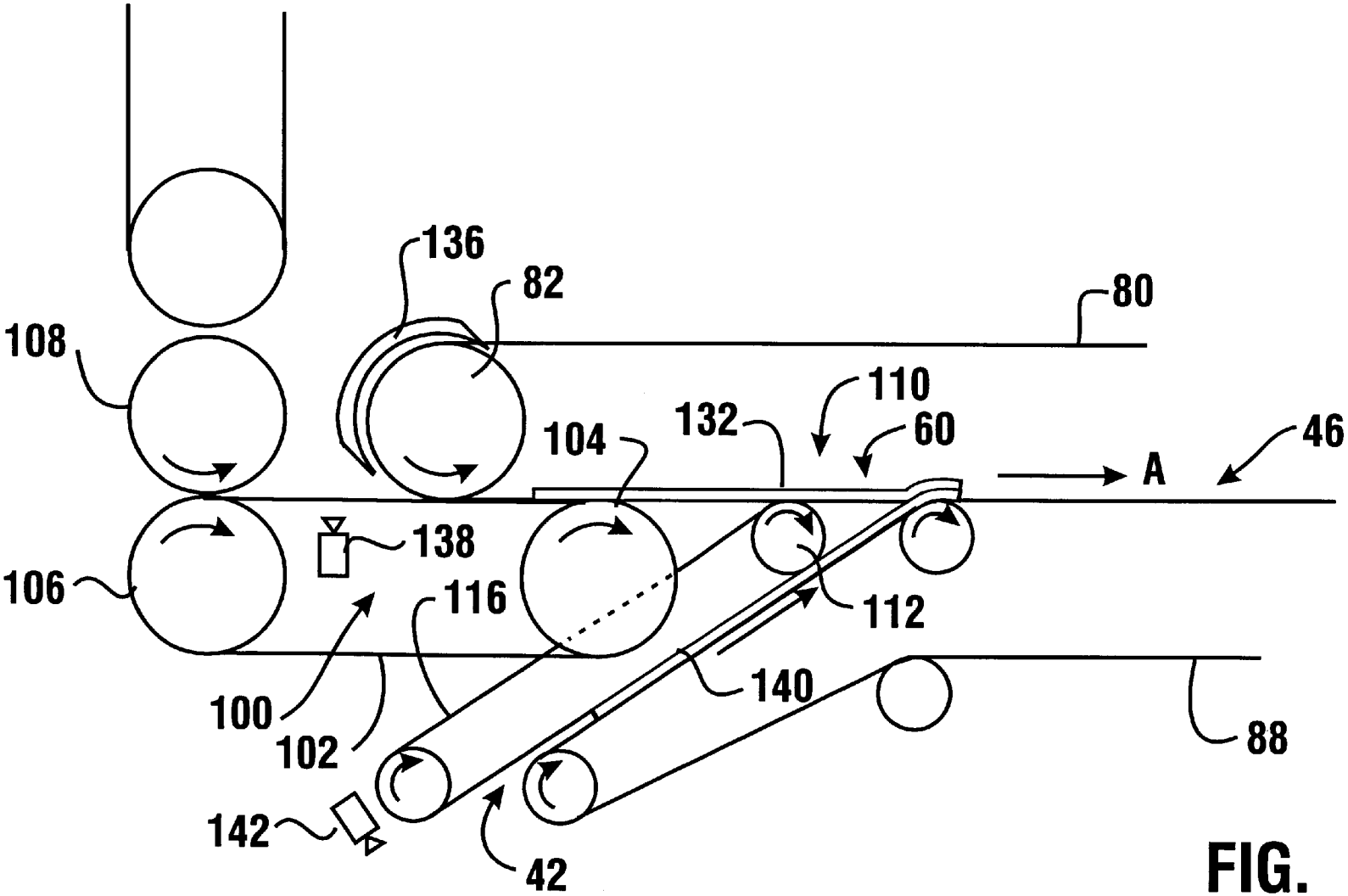
FIG. 10 is a view similar to FIG. 9 with the sheet moving in the intersection and engaging a second sheet being delivered through the second transport path, the second sheet engaging in aligned relation with the first sheet to form a stack.

The next step in the operation of the machine being described is represented in FIG. 10. A further sheet 140 is moved in transport path 42 towards the intersection 60. Sheet 140 may be dispensed by one of the sheet dispensing devices or is otherwise in the path and is moved towards the intersection. As sheet 140 moves adjacent to the intersection it is engaged by the belts 116 of sheet directing apparatus 110 as well as belts 88. Sheet 140 is also sensed by a sensor 142 in transport path 42. Sensor 142 is in operative connection with the control circuitry. The control circuitry operates to accurately coordinate the movement of the sheet 140 in engagement with the sheet directing apparatus 110 and belts 88.

As sheet 140 moves towards the intersection 60 the control circuitry operates to begin moving sheet 132 in the first direction along path 46 towards the intersection. The control circuitry coordinates the operation of the drives for the various components so that sheet 140 and sheet 132 pass through the intersection 60 in coordinated relation. As a result, sheets 132 and 140 engage in aligned, abutting relation so as to form a stack as they move through the intersection 60.

Figure 11:
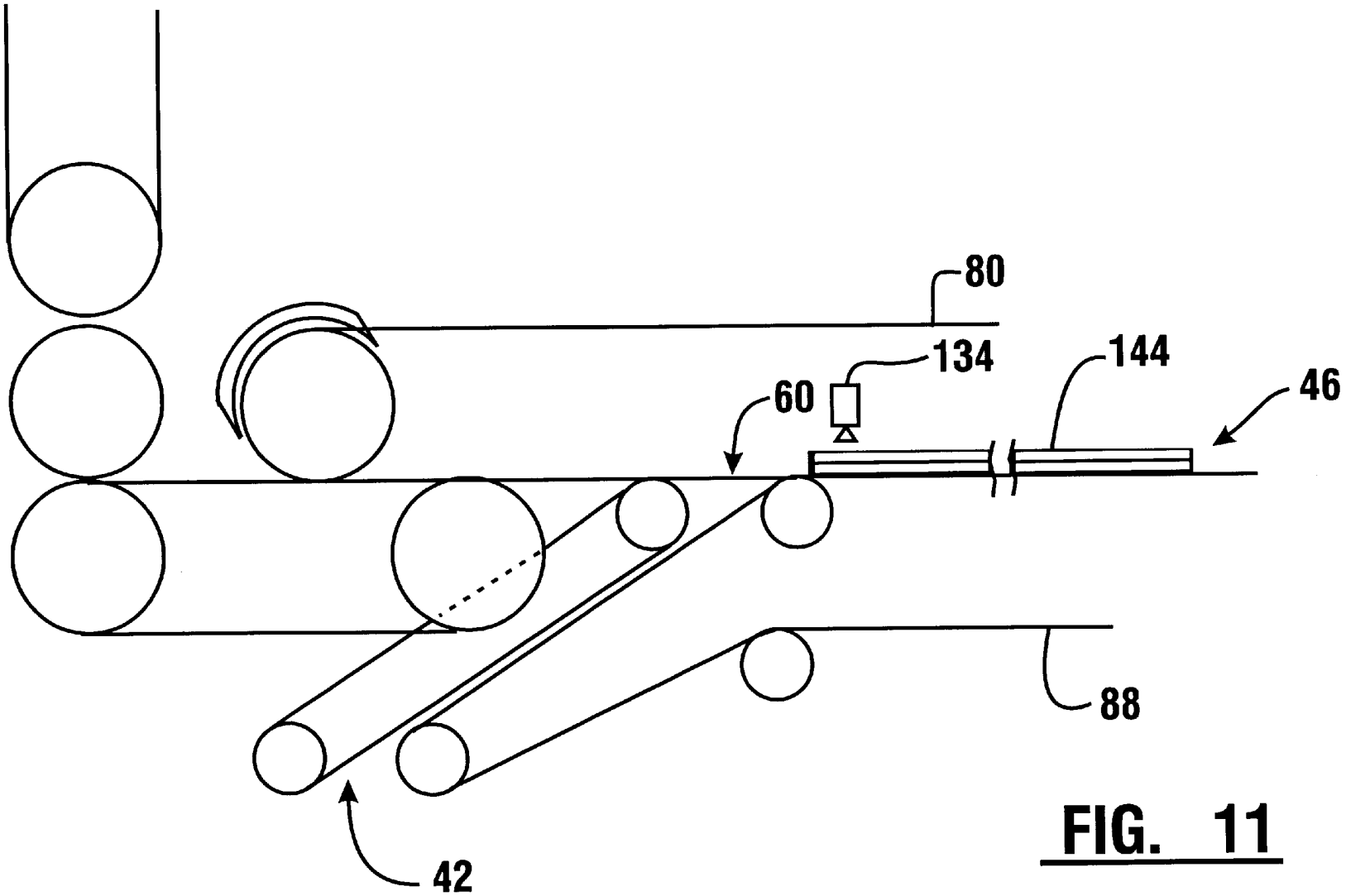
FIG. 11 is a schematic view similar to FIG. 10 in which the stacked pair of sheets have passed through the intersection.

As shown in FIG. 11 once sheets 140 and 132 have passed intersection 60 in the first direction, they are in a stack generally indicated 144. As schematically indicated in FIG. 11 in this mode of operation sensor 144 is operative to sense passage of the stack through the intersection and the control circuitry is operative to stop movement of the stack in the first direction in response to signals from the sensor. After sheets 132 and 140 have combined to form stack 144, additional sheets may be added to the stack. This is accomplished by moving the stack 144 in the second direction similar to that which is done with sheet 132 previously, as represented in FIG. 8. Stack 144 is moved to the position shown in FIG. 12 in which it is held by the holding device formed by holding rolls 108 and transport section 100. Thereafter, additional sheets may be added to the stack by passing sheets on transport path 42 and engaging such sheets in aligned relation with the stack in a manner similar to that represented in FIG. 10.

It will be appreciated that a stack comprising a significant number of aligned and abutting sheets may be formed in the manner described. Because the sheets are selectively dispensed from the dispensing devices adjacent to transport path 42, the sheets may be stacked in a desired order as determined by the control circuitry. For example, sheets which are currency may be stacked in order from highest to lowest denomination, or vice versa. Particular sheets may be placed in a desired location within the stack. Once the stack has been configured in the desired manner by the control circuitry of the machine, it may be moved in first transport path 46 to the opening 20 so it may be taken by a customer.

Figure 12:
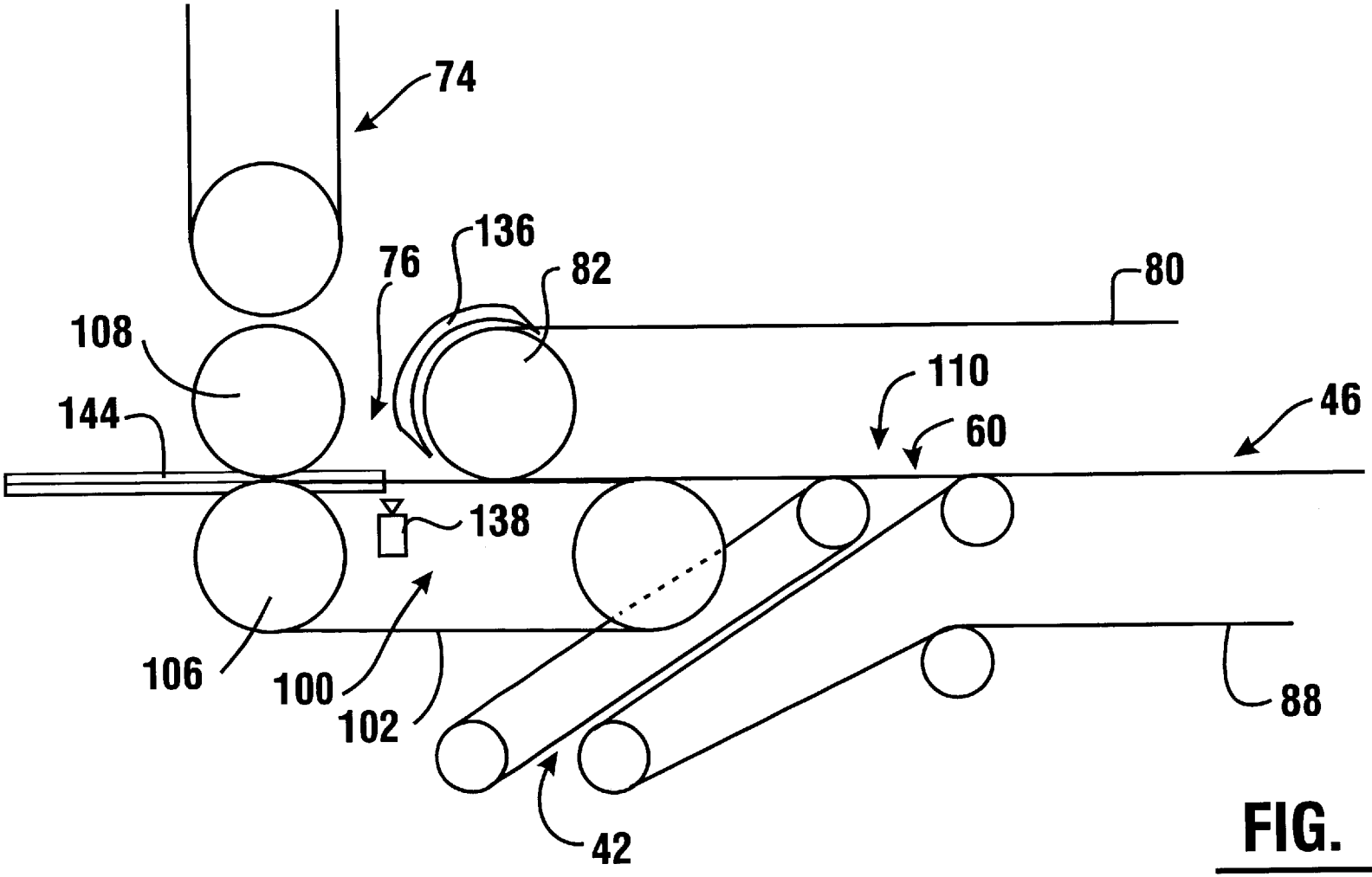
FIG. 12 is a schematic view similar to FIG. 11 in which the stacked sheets are held in the holding device.

It should also be noted that in the position of stack 144 shown in FIG. 12, the stack is positioned in the holding device formed by holding rolls 108 and transport section 100 adjacent to intersection 76. Intersection 76 is the intersection of transport path 46 and transport path 74. Transport path 74 extends to the devices housed in the upper enclosure portion 26 of machine 10.

Figure 16:
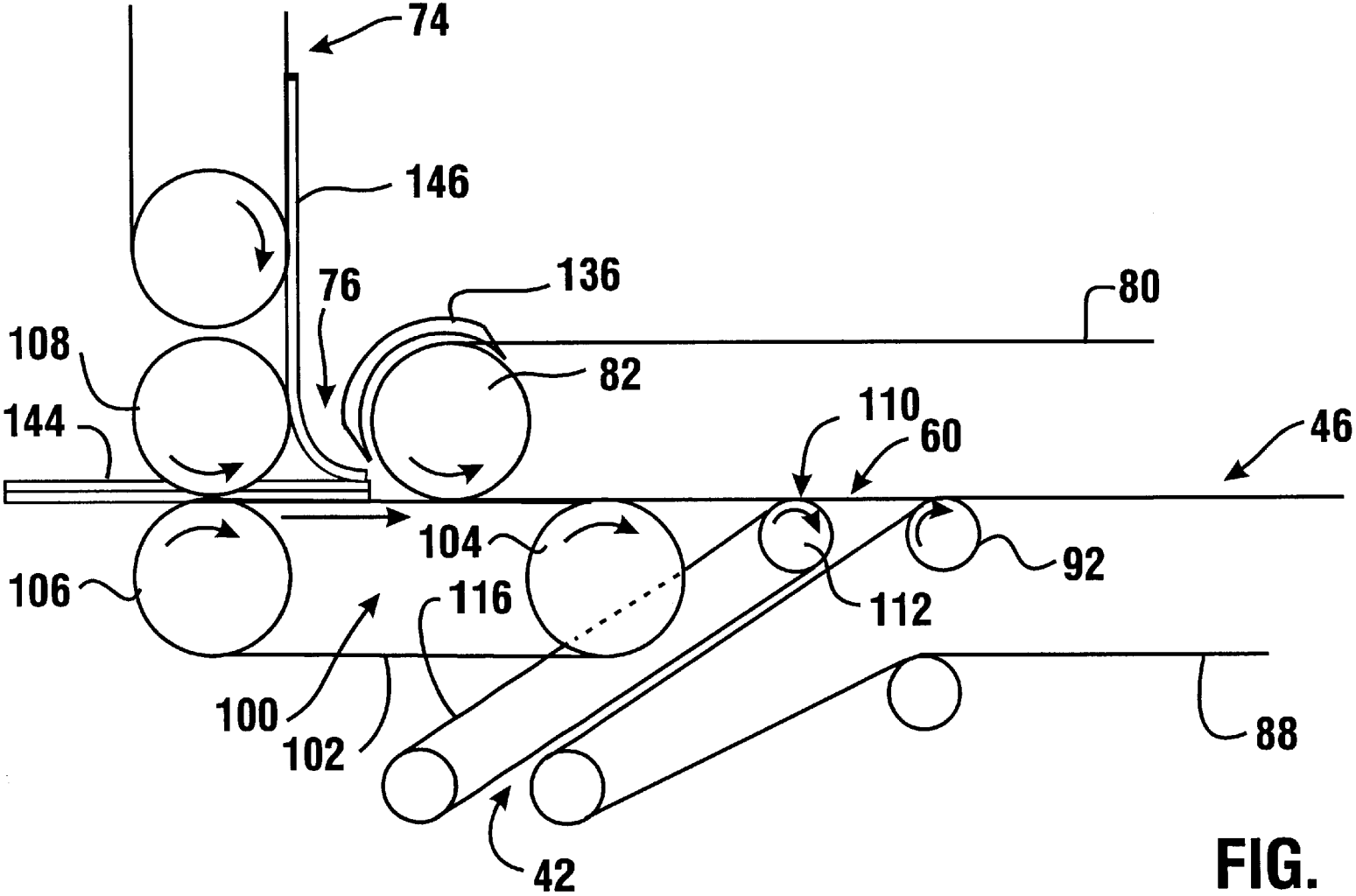
FIG. 16 is a schematic view showing a sheet passing through a second intersection between the first transport path and a third transport path.

As schematically represented in FIG. 16, a sheet 146 may be moved from one of the dispensing devices adjacent to sheet path 74 to engage the stack 144 at intersection 76 as the stack moves in the first direction. This enables adding sheets to the stack which are housed in the sheet dispensing devices adjacent to sheet path 74 The stack formed by the addition of sheets from sheet path 74 may be moved through sheet path 46 to the customer.

It will be understood that sheets from sheet path 74 may be delivered individually through intersection 76 into sheet path 46, and may thereafter be added to a stack formed at intersection 60 in a manner similar to that previously described. It should also be understood that sheet path 74 includes appropriate sensors that are operatively connected to the control circuitry. The control circuitry operates so that sheets from the sheet path 74 may be added to a stack in engaged, aligned relation with the other sheets in the stack as the sheets pass through intersection 76.

Figure 15:
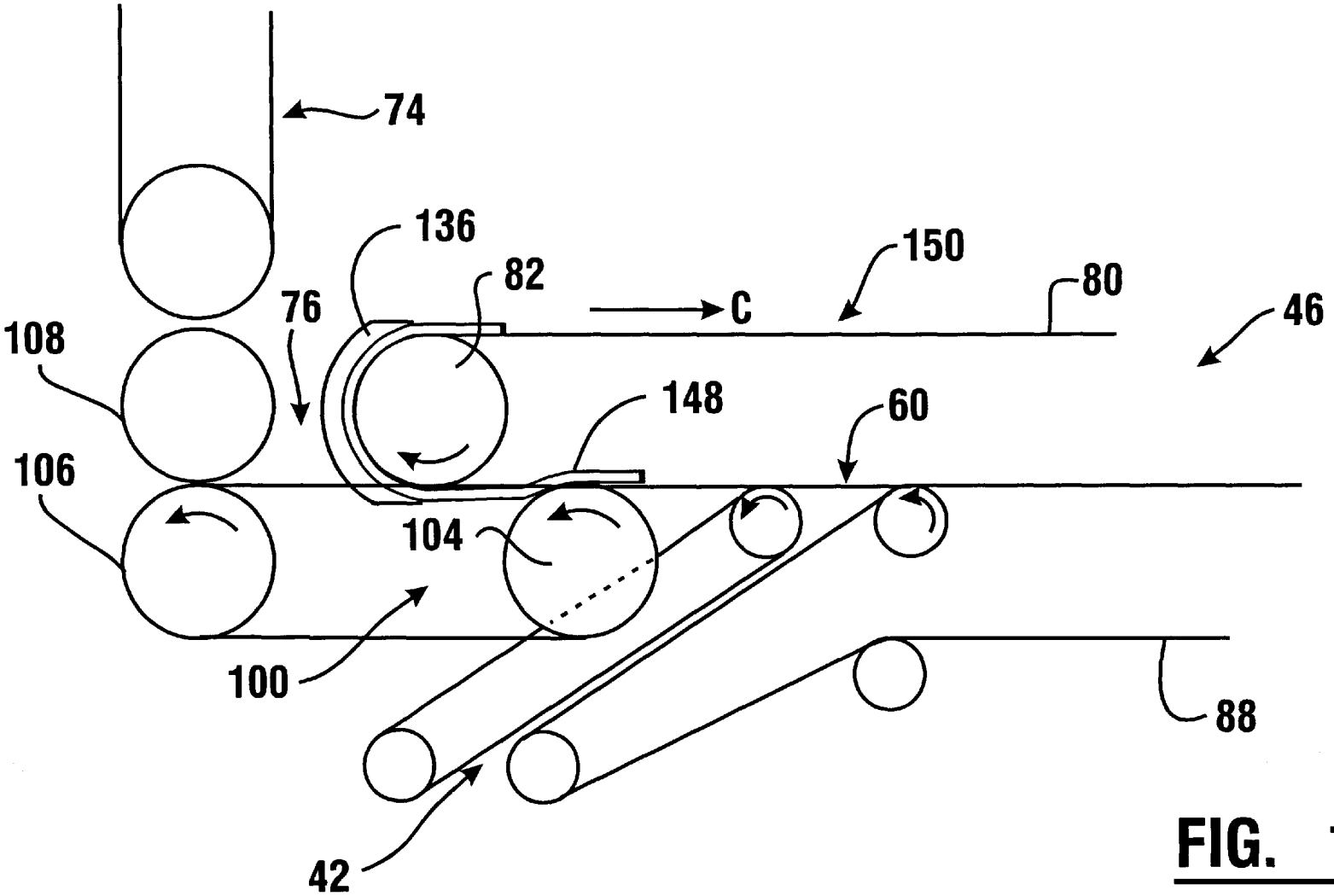
FIG. 15 is a schematic view of the first and second transport paths showing a sheet being re-oriented by a sheet turnover device.

As shown in FIG. 15 machine 10 further includes the capability of taking sheets in the first sheet path and turning them over using a turnover device. This may be done as shown in FIG. 15, through the use of sheet turnover member 136. Sheet turnover member 136 preferably comprises a member including arcuate guides or tines conforming to the contour of rolls 82. When the turnover member is positioned adjacent to rolls 82, such as in FIG. 15, a moving sheet 148 is caused to be turned over from the position of the sheet in the first sheet path 46. This is accomplished by moving sheet 148 in the direction of Arrow C in FIG. 15. In the preferred embodiment of the invention the upper belt flights of belt 80 are part of a sheet path generally indicated 150. Sheet path 150 extends adjacent to printing device 70 and imaging device 72 shown in FIG. 3. As a result, the sheet may be selectively moved into sheet path 150 for purposes of conducting printing thereon, for producing an electronic image of the sheet, or both.

Once the printing or imaging activity has been conducted on the sheet in sheet path 150, the sheet is returned to the first sheet path 46. Once the sheet 148 is returned to the first sheet path it may be selectively moved to one of the other sheet paths 42 or 74. From these sheet paths it may be directed into and stored in an appropriate sheet storage device. Alternatively, sheet 148 may be selectively moved to be combined in a stack with other sheets at intersections 60 or 76.

In embodiments of the invention, the sheet turnover members 136 may be configured so that sheets in transport path 150 may be directly added to a stack of sheets at the intersection of sheet path 46 and the turnover device. This is accomplished by configuring or moving the turnover member so that the tines in the lower position do not interfere with the passage of a stack of sheets in the first direction past the turnover member. This feature may be particularly advantageous when a customer receipt is printed on a sheet by the printer in sheet path 150, and it is desired to have the receipt at the top of the stack. This may be achieved by positioning the stack in the holding device formed by holding rolls 108 and transport section 100, and moving the stack in the first direction to the right in FIG. 15 as the printed receipt sheet is engaged in aligned relation with the top of the stack as the stack moves toward opening 20.

It should be understood that in other embodiments, sheets from paths 74 and 42, as well as from path 150, may all be added to a stack as the stack moves from the holding device provided by transport section 100 and holding rolls 108, in the first direction towards the customer. This can be readily envisioned from the schematic view shown in FIG. 16 with the stack 144 moving to the right as shown, and sheets being added to the stack as the stack passes roll 82 and again as the stack moves through intersection 60. As will be appreciated by those skilled in the art, numerous configurations and operations of the system may be provided depending on the functions carried out by the machine as well as the programming and configuration of the control circuitry.

Figure 18:
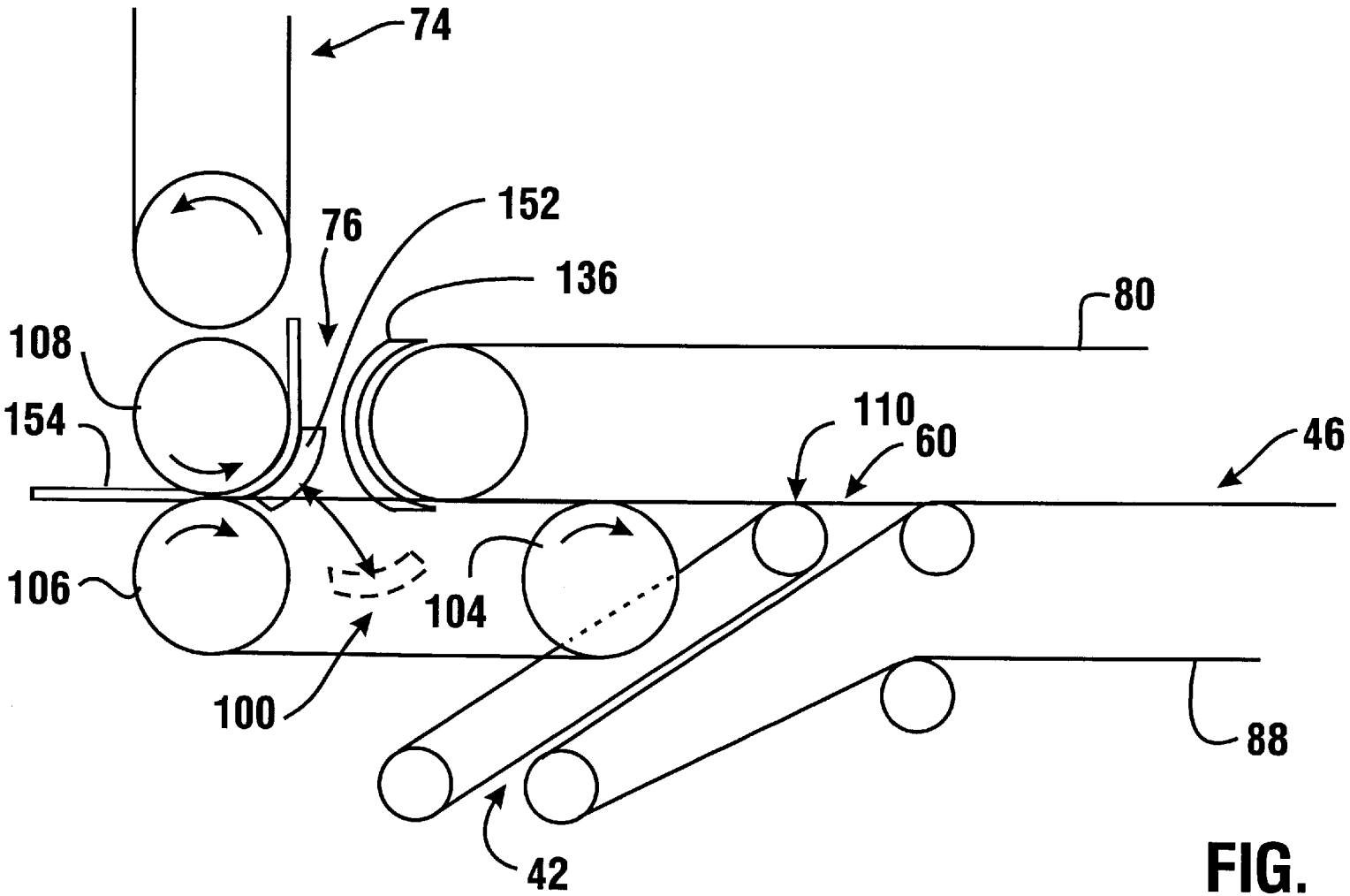
FIG. 18 is a schematic view showing the first, second and third transport paths, with a sheet moving from the holding device to the third transport path.

It should be understood that other sheet turnover devices, other than, or in addition to turnover member 136, may be provided in embodiments of the invention. For example, in FIG. 18 a directing member 152 is shown in cooperating relation with roll 108. Directing member 152 is selectively movable between the position shown, wherein it is adjacent to roll 108 and the position shown in phantom. As represented in FIG. 18, when the directing member 152 is in the position shown it is operative to direct a sheet 154 that is held in the holding device formed by transport section 110 and holding rolls 108 into transport path 74. Sheet 154 may be moved in transport path 74 to a sheet receiving device for storage therein in the manner previously discussed.

Alternatively, turnover of the sheet 154 may be accomplished by moving it into transport path 174 and thereafter disposing directing member 152 away from roll 108. Once this is done, sheet 154 may again be directed into path 146 and moved to the right as shown in FIG. 18 so that sheet 154 will move in a manner comparable to that of sheet 146 shown in FIG. 16. This will result in the orientation of sheet 154 being reversed in sheet path 46 from its original orientation.

The components adjacent to intersection 60 may also be operated as a sheet turnover device. This is represented schematically in FIG. 20. This is accomplished by having a sheet 156 initially positioned in the first sheet path similar to sheet 132 in FIG. 7. The sheet is then moved into the second sheet path at intersection 60 by operating the sheet directing apparatus 110 in a manner that is later discussed in detail. Once sheet 156 is in the second sheet path, the direction of belts 88 and 116 is reversed while the lower flights of belt 80 are moved to move the sheet in the second direction indicated by Arrow B. This results in the sheet being turned over from its original orientation in the transport.

Figure 20:
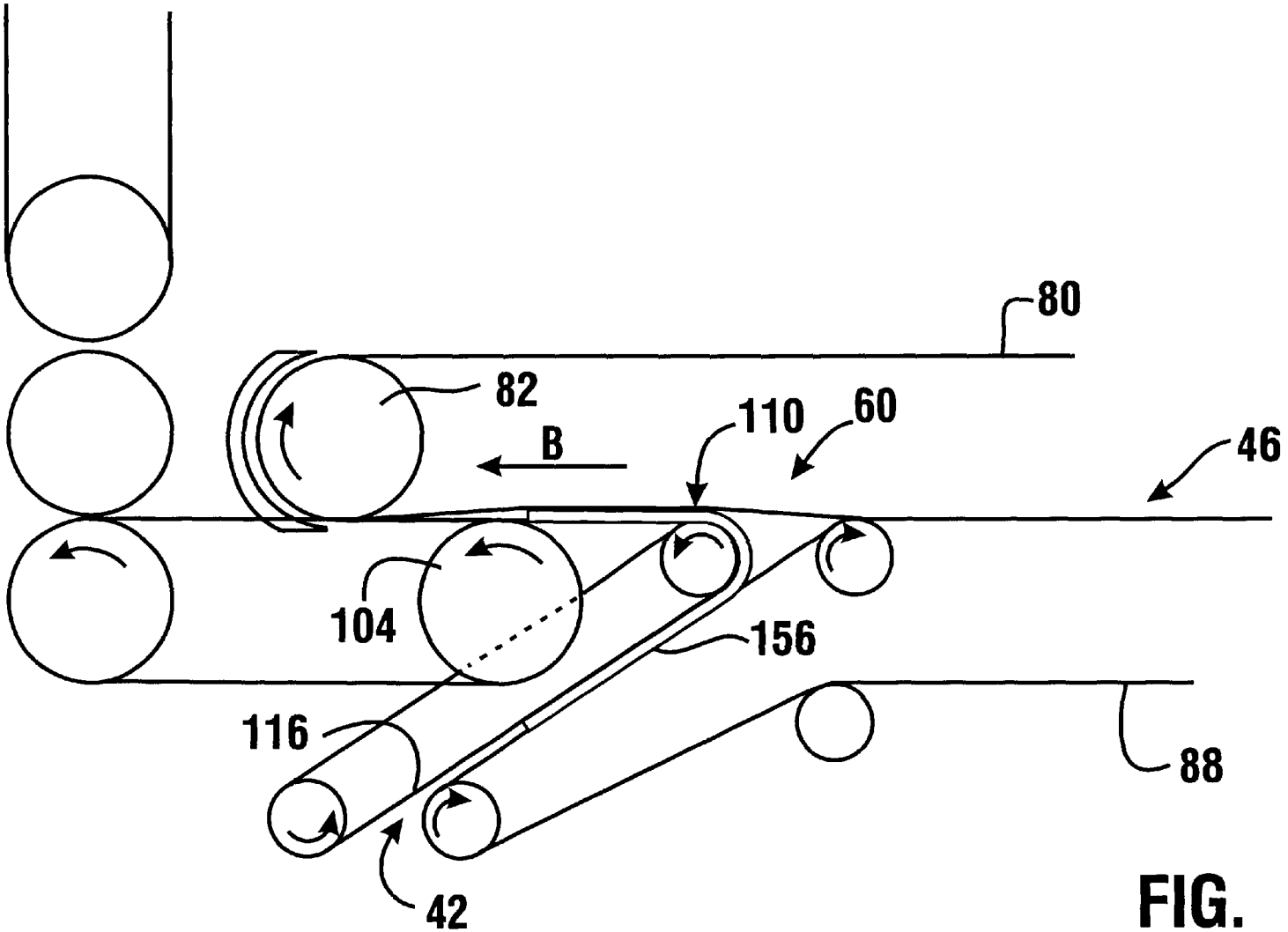
FIG. 20 is a schematic view showing the first and second transport paths with a sheet moving from the second transport path to the first transport path, and schematically demonstrating how the sheet directing apparatus is used as part of a sheet turnover device.

It should be further understood that sheets which originate in transport path 42 may also be directed in the manner shown in FIG. 20. This feature enables selectively positioning sheets and turning them over through a number of different mechanisms this enhances the capabilities of the automated banking machine.

Figure 13:
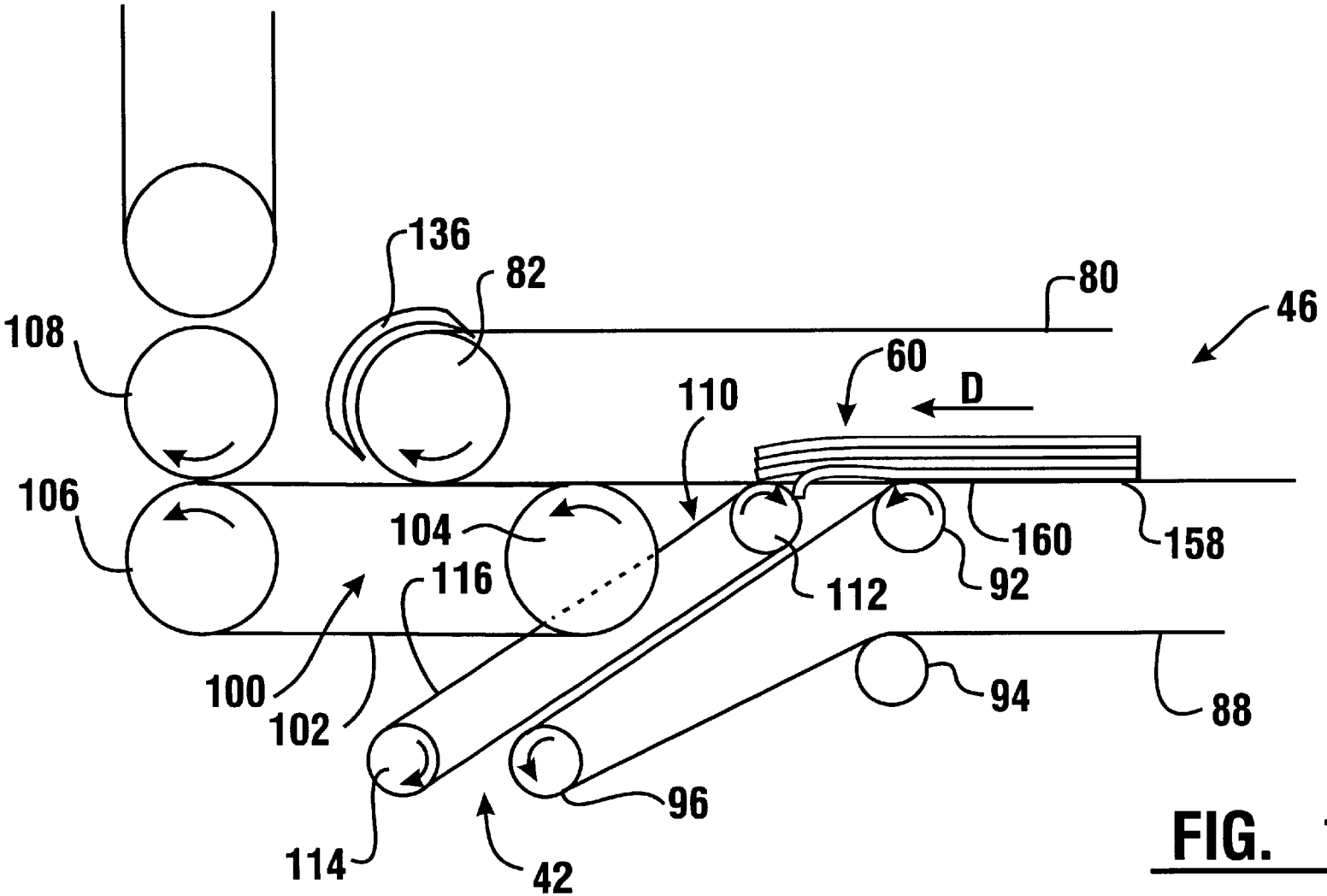
FIG. 13 is a schematic view of the first and second transport paths with the sheet directing apparatus operating to separate a first sheet from a stack as the stack passes through the intersection.
Figure 14:
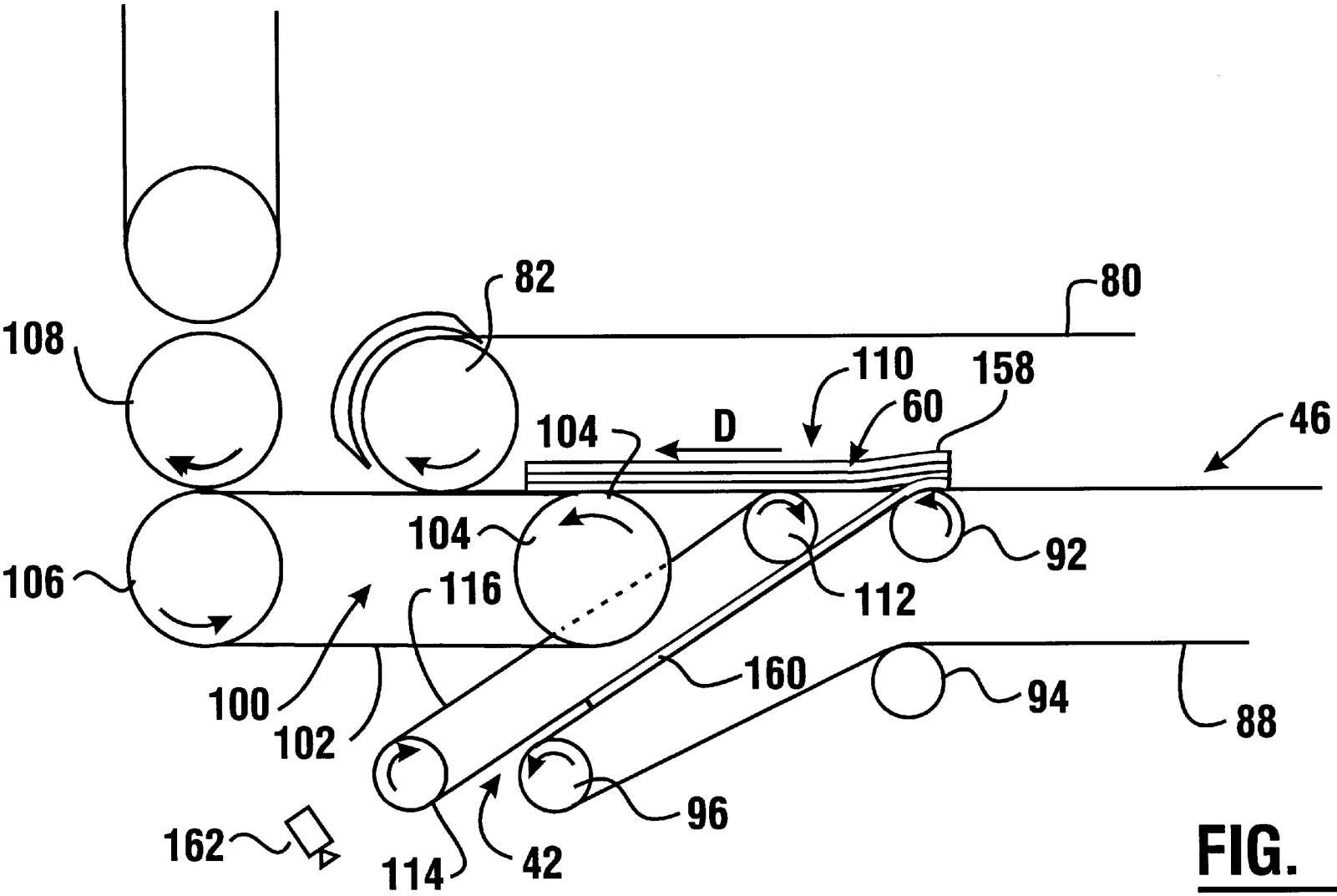
FIG. 14 is a schematic view similar to FIG. 13 showing the sheet separating from the stack as the stack passes through the intersection.

A further fundamental aspect of the preferred embodiment of the present invention is demonstrated schematically in FIGS. 13 and 14. The embodiment of the present invention shown includes the capability of selectively separating a sheet from a stack of sheets as the stack passes through the intersection 60 of transport path 46 and transport path 42. As schematically represented in FIG. 13, a stack of sheets 158 moves in the direction indicated by Arrow B in transport path 46. Although stack 158 is shown as a stack of four sheets, it should be understood that the stack may comprise a greater or lesser number of sheets. Stack 158 may be a stack of sheets received from a user of the machine through opening 20 and may consist of different sheet types.

As stack 158 moves toward intersection 60 the control circuitry of the machine operates sheet directing apparatus 110 so that rolls 112 and 114, and belts 116 journaled thereon, move relative to the stack in a direction opposed to the direction of stack movement. As a result of this movement by the sheet directing apparatus, a first sheet 160 which bounds a first side of the stack, is frictionally engaged by belts 116 and is stripped and separated from the stack. The first sheet 160 is directed into the sheet path 42 as the stack which comprises the remaining sheets continues on path 46. This enables sheet 160 to be handled separately by the devices adjacent to path 42, or to be later brought individually back to path 46 for individual transport to devices adjacent to other paths.

It should be noted that in the preferred embodiment a sensor 162 is positioned adjacent to path 42. Sensor 162 may be a photo electric sensor connected to the control circuitry for sensing the position of the sheet. Alternatively, sensor 162 may comprise a plurality of similar or different sensors adapted for sensing features of a sheet, such as its type and denomination. This enables the control circuitry to properly identify a currency sheet and place it in a designated position within the sheet receiving devices. Sensors 162 may alternatively operate in connection with the control circuitry to determine the genuineness of a sheet. In other embodiments other features such as magnetic ink indicia, bar coding and other features may be detected for purposes of identifying the type of sheet as it moves past the sensors.

After sheet 160 is separated from the stack 158 as shown in FIG. 14, the control circuitry may operate the transports in the first path 46 to move the remaining stack to a position to the right of the intersection 60. If it is desired to separate an additional sheet from the stack, the remaining sheets may be moved through the intersection again in the direction of Arrow D to accomplish separation of the sheet that is newly bounding the side of the stack. Alternatively, if the control circuitry determines that it is not necessary to separate a further sheet from the stack, the sheet directing apparatus may be operated so that belts 116 and rollers 112 and 114, move in the same direction as rollers 92 and at a similar speed. This will result in the stack passing through the intersection without a sheet being separated from the stack.

It should be understood that while in the embodiment shown the sheet directing apparatus comprises a plurality of rolls having resilient surfaces thereon that move at a relative speed that is less than the speed of the moving stack, in other embodiments other types of stripping and separating devices may be used. These may include for example, resilient pads or rolls. Such devices may also include resilient suction cup type mechanisms or vacuum generating devices. Further alternative forms of sheet directing devices may include other physical members that engage selectively one or more sheets so as to direct them from path 46 into another path 42.

It should also be noted that in the embodiment shown in FIGS. 13 and 14, sheets may be separated from a stack as the stack moves from right to left. However, in other embodiments of the invention it may be desirable to arrange the sheet directing apparatus so that sheets may be separated from a stack when the stack moves in either direction. This may be readily accomplished through arrangements of resilient rollers or other stripping devices or members which may be selectively actuated to engage and separate a sheet upon passage of a stack through an intersection. This configuration may have advantages in other embodiments where greater speed in sheet separation is desired.

As will be appreciated from the foregoing discussion, in some banking machines it may be desirable to process certain sheets individually. For example, if it is determined that a sheet separated from a stack is a check or other negotiable instrument that must be transferred to the imager, it may be desirable to clear a path which enables the sheet requiring such handling to be transported individually. This can be accomplished by disposing the stack of sheets that are not currently being processed individually away from the single sheet in first path 46. In this manner the sheet requiring individual handling can be transferred to path 150 or such other location as may be necessary without causing the remaining stack to undergo transport to an undesirable location.

Figure 19:
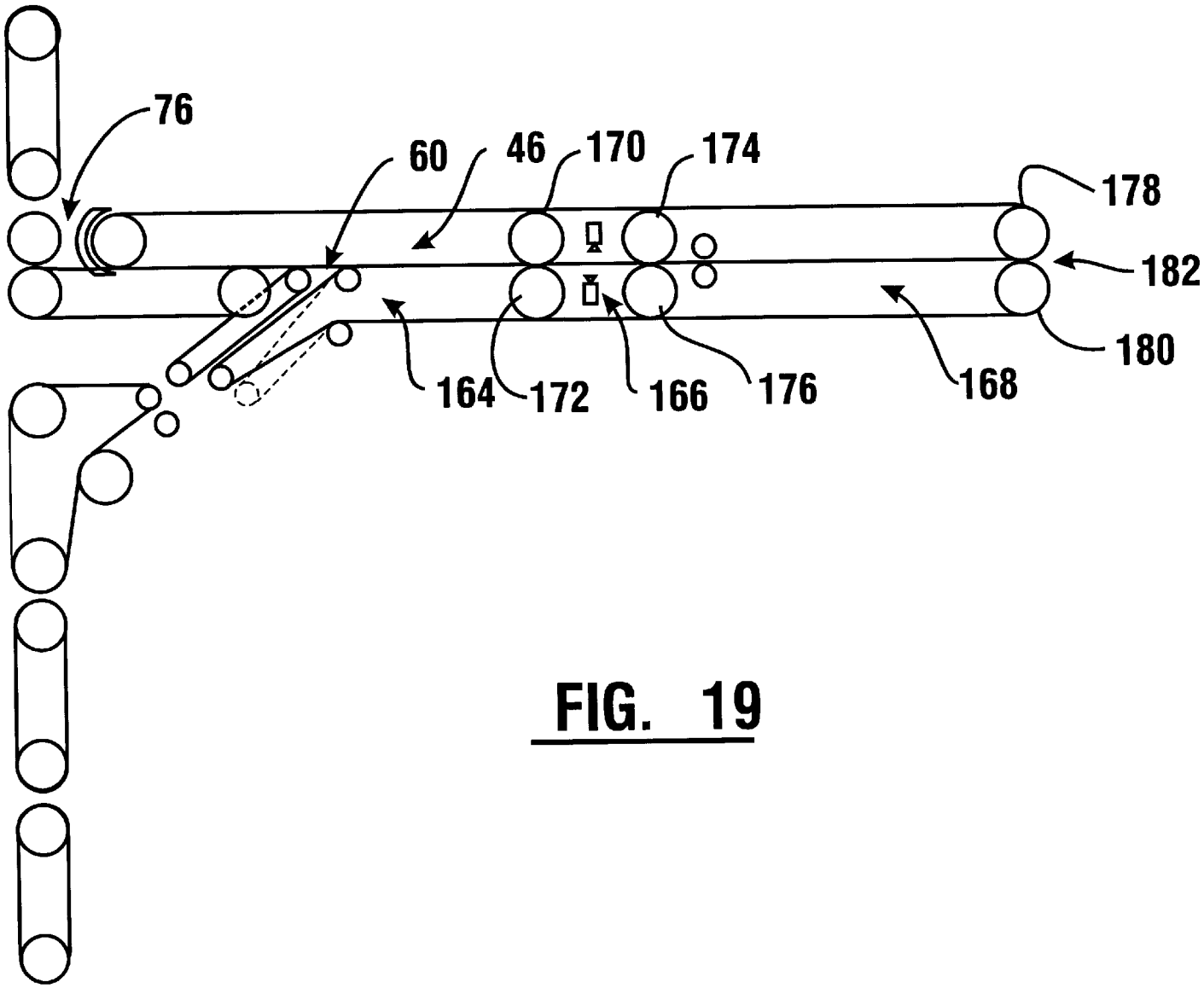
FIG. 19 is a schematic view of an alternative embodiment of the first, second and third transport paths with additional holding devices in the first transport path.

A further alternative to facilitate individual handling of particular sheets is represented by the alternative embodiment shown in FIG. 19. In this embodiment path 46 includes three separately controlled transport sections 164, 166 and 168 Transport section 164 is similar to the transport previously discussed, except that its belts terminate at rolls 170 and 172. Transport section 166 is an interwoven belt transport similar to that shown in FIG. 5 with the exception that its belts are offset from those in transport section 164. Transport section 166 is preferably driven by an independent reversible drive from transport section 164. The drive for transport section 166 is in operative connection with and operates under the control of the control circuitry.

Transport section 166 terminates in rolls 174 and 176. Rolls 174 and 176 are coaxial with other rolls that are spaced intermediate thereto that are part of transport section 168. Transport section 168 terminates at rolls 178 and 180 which are adjacent to a customer accessible opening indicated 182. Transport section 168 is operated by an independent reversible drive in response to the control circuitry.

Transport sections 166 and 168 along path 46 provide locations in which documents or stacks of documents may be temporarily stored as other documents are routed through intersections 60 and 76. After the necessary processing is done on the individual documents, the documents that are temporarily stored in the transport sections 166 and 168 may be moved to other transport sections for further processing. It should be understood that transport sections 166 and 168 include appropriate sensors for sensing the positions of the documents being temporarily stored therein which enables the control circuitry to coordinate movement thereof.

Figure 17:
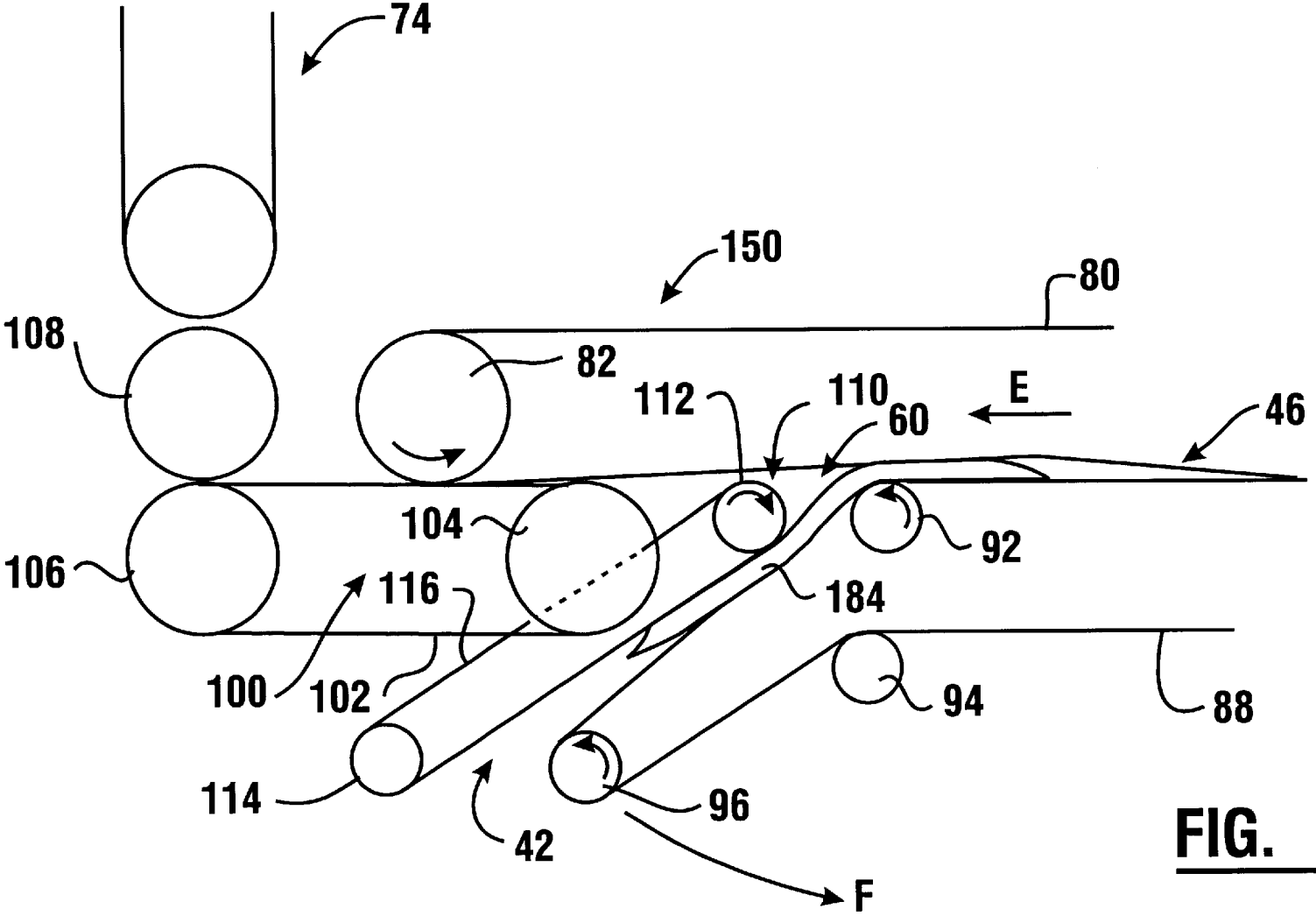
FIG. 17 is a schematic view of the first and second transport paths with a deposit envelope passing therethrough.

A further advantage of the preferred embodiment of the invention is that not only may the automated banking machine 10 accept individual documents and stacks of documents from a customer, but it may also accept conventional deposit envelopes. As shown in FIG. 17 a thick sheet like deposit envelope 184 may be moved along path 46 from a customer. The identification of the deposited item as a deposit envelope may be made based on readings from sensors 126, 128 or 130 as shown in FIG. 4, or alternatively based on customer inputs at the customer interface 12 of the machine.

Deposit envelope 184 moves in transport path 46 in the direction of Arrow E as shown in FIG. 17. Upon determining that the item moving in the transport path is a deposit envelope, the control circuitry operates the sheet directing apparatus 110 to direct the envelope into transport path 42. The control circuitry also enables roll 96 and belts 88 to move in the direction indicated by Arrow F. This causes the flight of belt 88 to move to the position shown in phantom in FIG. 4. This enables the envelope to move into the depository device 40 (see FIG. 3) in which it may be stacked in aligned relation with other envelopes. Further the control circuitry may also operate transport 118 and rolls 124 shown in FIG. 4 to assure that envelope 184 does not pass further along sheet transport path 42 than the depository 40.

The ability of the preferred embodiment of the automated banking machine to handle depository envelopes, stacks of sheets and individual sheets, provides enhanced functionality for the machine. The ability of the preferred embodiment to accept thick items in the area of path 42 adjacent to the intersection, also enables the control circuitry to use the area adjacent to the intersection as a temporary storage location for stacks of sheets. This may be desirable in some embodiments where a receipt form is delivered on transport path 74 and must be directed to transport path 150 for printing thereon before being combined with a stack to be delivered to a customer.

The preferred embodiment of the present invention has the capability of storing the assembled stack of sheets adjacent to intersection 60 in transport path 42 until such time as the printed receipt is moved into the intersection along first path 46. As the receipt form is moved into the intersection 60 by transport section 100, the stack is moved into the intersection in coordinated relation therewith so that the printed receipt is positioned at the top side of the stack. The completed stack may be moved along transport path 46 to the opening where it may be taken by the customer.

Figure 23:
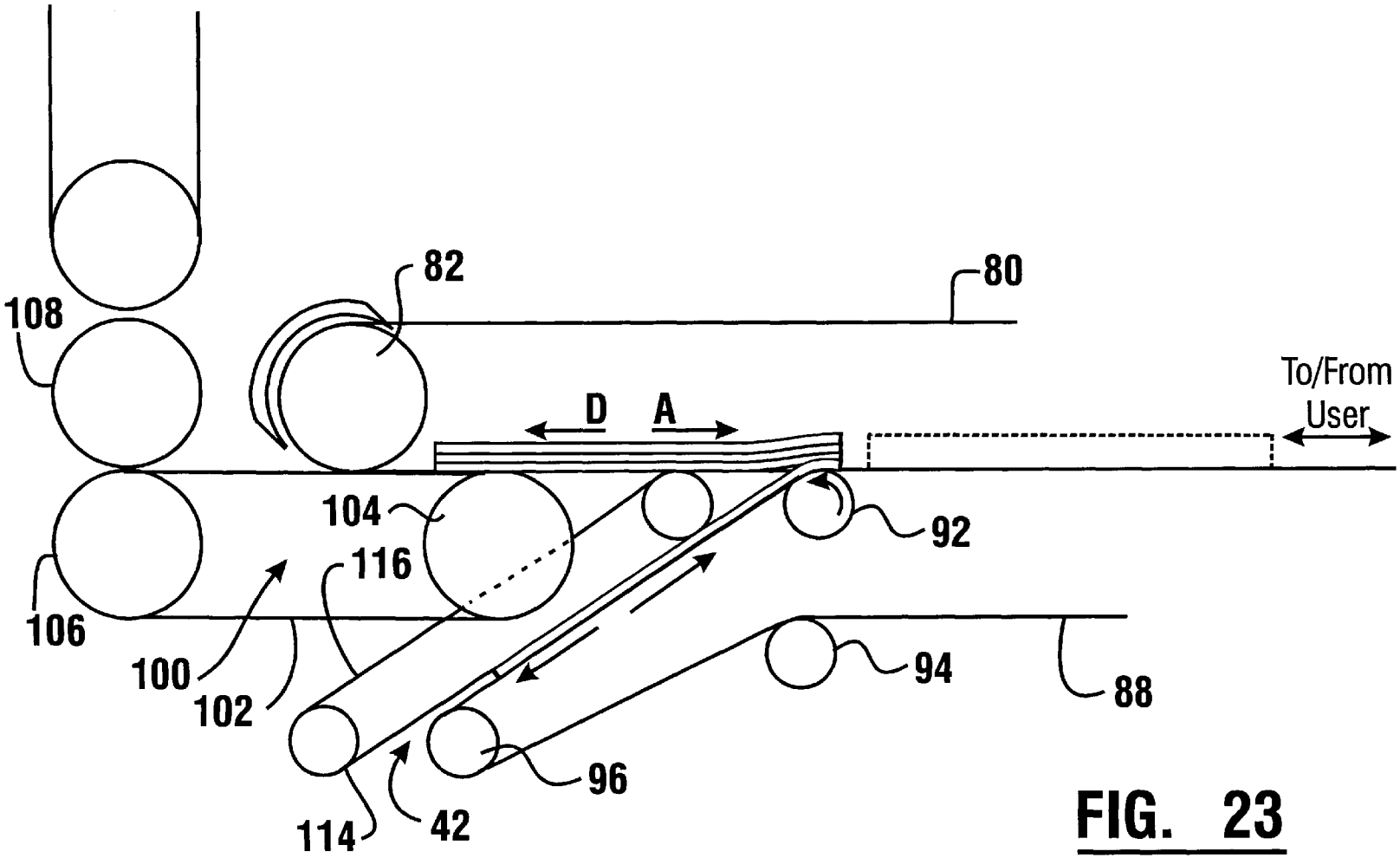
FIG. 23 shows a sheet separating from or adding to the stack as the stack passes thorough the intersection.

FIG. 23 shows an example of a sheet separating from or adding to the stack as the stack passes through the intersection. The stack may be moved in the direction indicated by Arrow D to remove a sheet from the stack. The stack may be moved in the direction indicated by Arrow A to add a sheet to the stack. The stack shown in phantom represents the stack either prior to movement in the direction of Arrow D into the intersection or after movement in the direction of Arrow A through the intersection. The stack may be moved through the intersection several times to add or remove sheets. Of course, the stack may also pass through the intersection without the addition or removal of a sheet.

Figure 22:
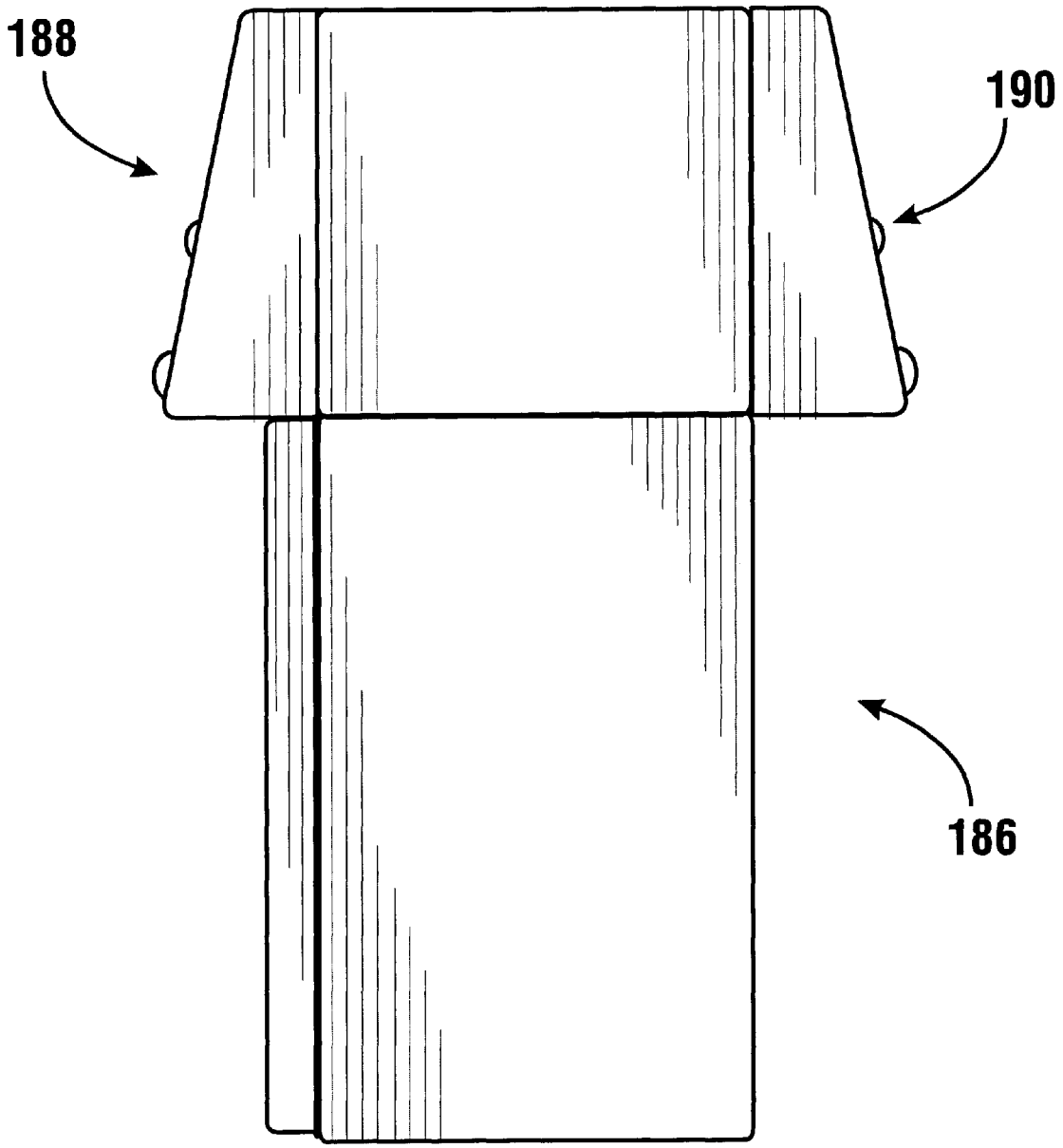
FIG. 22 is a side view of an automated banking machine housing the transport apparatus schematically shown in FIG. 21.

An alternative embodiment of an automated banking machine incorporating the present invention is indicated 186 in FIG. 22. Machine 186 is similar to machine 10 except that it includes two fascias and customer interfaces designated 188 and 190. Machine 186 is capable of operation by two users generally simultaneously.

Figure 21:
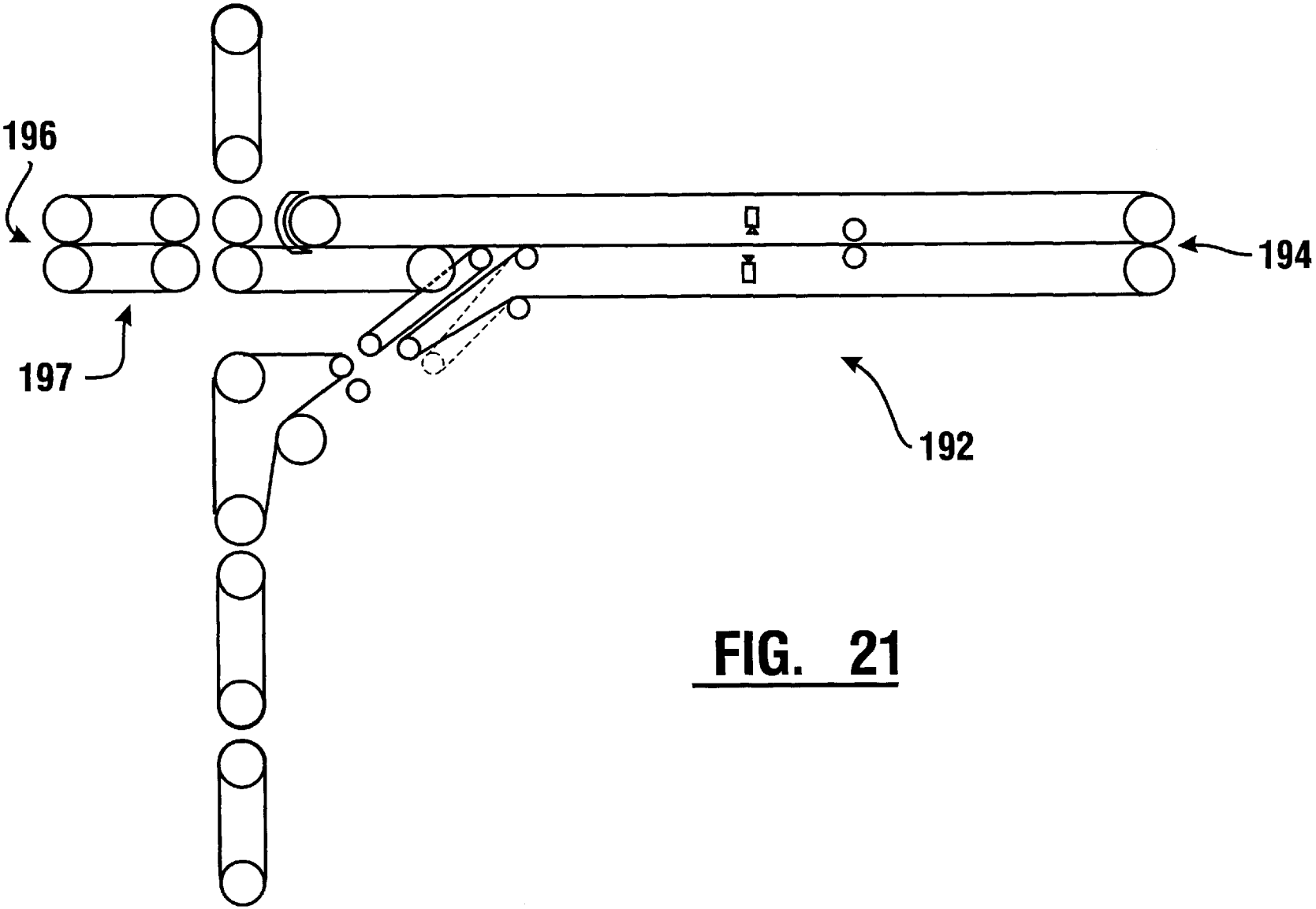
FIG. 21 is a schematic view of an alternative embodiment of the first, second and third transport paths used in an alternative automated banking machine in which two user interfaces and user accessible openings are provided.

The sheet handling mechanism for machine 186 is indicated 192 in FIG. 21. The sheet handling mechanism 192 is similar to that described in the first embodiment, except as otherwise noted. Mechanism 192 includes a first customer accessible opening 194 in customer interface 190, and a second customer accessible opening 196 in customer interface 188. Customer opening 196 receives and delivers sheets through a transport section 197. Transport section 197 is preferably an interwoven belt type transport of the type shown in FIG. 5 and is capable of moving sheets, envelopes and stacks of sheets in engagement therewith. Transport section 197 is operated by a reversible drive similar to the reversible drives used for the other belt transport sections, and is in operative connection with the control circuitry of the machine.

The operation of the alternative sheet handling mechanism 192 is similar to that previously described except that the sheets, envelopes or stacks of sheets that are processed may be received from or delivered to either customer opening 194 or customer opening 196. Because of the high speed capability of the preferred embodiment it is possible for the sheet handling mechanism 192 to adequately service two users simultaneously without undue delay.

As will be appreciated from the foregoing description, the modifications necessary for the sheet handling mechanism of the first embodiment to accommodate two simultaneous users is relatively modest. In the preferred embodiment of the invention it is possible to increase the number of customer interfaces on the machine from one to two at a relatively small cost. This is particularly advantageous for an automated teller machine positioned in a high customer traffic area. It is also useful for automated banking machines, such as those used by tellers to count and dispense currency notes. This is because the configuration of the sheet handling mechanism enables two tellers or other personnel to be serviced by a single machine.

Thus the new automated banking machine of the present invention achieves the above stated objectives, eliminates difficulties encountered in the use of prior devices and systems, solves problems and attains the desirable results described herein.

In the foregoing description certain terms have been used for brevity, clarity and understanding. However, no unnecessary limitations are to be implied therefrom because such terms are used for descriptive purposes and are intended to be broadly construed. Moreover the descriptions and illustrations given are by way of examples and the invention is not limited to the exact details shown or described.

In the following claims any feature described as a means for performing a function shall be construed as encompassing any means capable of performing the recited function, and not mere equivalents of the particular means described in the foregoing description.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. An automated banking machine apparatus comprising:

a first sheet path;

a first drive moving sheets in the first sheet path;

a second sheet path intersecting with the first sheet path at an intersection;

a second drive moving sheets in the second sheet path;

a first sensor sensing a first sheet in the first sheet path;

a second sensor sensing a second sheet in the second sheet path;

control circuitry in operative connection with the first drive, the second drive, the first sensor and the second sensor, wherein the control circuitry is operative to control the first and second drives to cause the first sheet and the second sheet to engage in aligned, stacked relation as a stack as the first and second sheets move through the intersection, and further operative to add an additional sheet to the stack.

2. The apparatus according to claim 1 and further comprising an imaging device in operative connection with the control circuitry, wherein the imaging device is selectively operative to capture an electronic image of an imaged sheet positioned in an imaged sheet path, and wherein the first sheet path is selectively connectable with the imaged sheet path, wherein an imaged sheet is selectively directed from the first sheet path to the imaged sheet path, whereby an electronic image is made of the imaged sheet by the imaging device.

3. The automated banking machine according to claim 1 wherein the first sheet path extends to a user accessible opening on the machine, whereby the stacked first and second sheets are adapted to be delivered to a user of the machine.

4. The apparatus according to claim 1 wherein the first sheet path includes at least one holding device in operative connection with the control circuitry, and wherein the holding device is operative to selectively hold at least one sheet away from the intersection as at least one other sheet moves through the intersection, and wherein the holding device is thereafter operative to release at least one sheet to move through the intersection.

5. The apparatus according to claim 1 and further comprising at least one sheet dispensing device in operative connection with the control circuitry, wherein the sheet dispensing device is in operative connection with the first sheet path and enables selectively delivering a sheet thereto.

6. The apparatus according to claim 1, wherein the first and second sheets move in a first direction in the intersection as they are engaged in stacked relation, and further comprising:

a sheet directing apparatus adjacent the intersection of the first and second sheet paths, wherein the sheet directing apparatuis is in operative connection with the control circuitry and is selectively operative to direct at least one sheet moving in an opposed direction through the intersection to either the first sheet path or the second sheet path;

and wherein the control circuitry is operative to cause the first drive and the sheet directing apparatus to move the stack comprising the first and second sheets in the opposed direction in the first sheet path beyond the intersection, and thereafter to move the stack including the first and second sheets in the first direction towards the intersection and to cause the stacked first and second sheets and a further second sheet moving in the second sheet path to engage in aligned, stacked relation as the first, second and further second sheets move through the intersection.

7. The apparatus according to claim 6 and further comprising:

a holding device in operative connection with the first sheet path, wherein the holding device is in operative connection with the control circuitry, and wherein the holding device is operative to selectively hold or release sheets in the first sheet path, and wherein the stacked first and second sheets are held in the holding device prior to being released in the first sheet path to engage the further second sheet.

8. The apparatus according to claim 1 and further comprising at least one sheet dispensing device in operative connection with the control circuitry, and wherein the dispensing device is operative to selectively deliver a sheet into the second sheet path.

9. The apparatus according to claim 8 and further comprising at least one further sheet dispensing device in operative connection with the control circuitry, and wherein the further sheet dispensing device is in operative connection with the first sheet path other than through the second sheet path, and wherein the further sheet dispensing device selectively delivers a further sheet to the first sheet path, whereby the further sheet is delivered through other than the second sheet path.

10. The automated banking machine according to claim 1 wherein the stacked first and second sheets are moved together in the first direction beyond the intersection, and further comprising a sheet directing apparatus adjacent the intersection, wherein the sheet directing apparatus is in operative connection with the control circuitry, and wherein the sheet directing apparatus is selectively operative to separate the second sheet from the first sheet and direct the second sheet into the second sheet path as the first and second sheets move in an opposed direction through the intersection.

11. The apparatus according to claim 10 wherein the control circuitry is selectively operative to control the first drive, the second drive and the sheet directing apparatus, to move the second sheet in the second sheet path to the intersection and then to move the second sheet in the first sheet path in the opposed direction from the intersection, whereby the second sheet is turned over relative to its prior orientation.

12. The apparatus according to claim 1 and further comprising a printing device in operative connection with the control circuitry, wherein the printing device is selectively operative to print on a printing sheet positioned in a printer sheet path, and wherein the first sheet path is selectively connectable with the printer sheet path, wherein a printing sheet in the first sheet path is selectively directed to said printer sheet path, whereby printing is enabled to be conducted on the printing sheet.

13. The apparatus according to claim 12 wherein after printing is conducted on the printing sheet, the printing sheet is directed from the printer sheet path to the first sheet path.

14. The apparatus according to claim 12 wherein after the printing sheet is returned to the first sheet path, the printing sheet is engaged in aligned stacked relation with at least one other sheet from the second sheet path as the printing sheet moves in the first direction through the intersection.

15. A method of operation of an automated banking machine apparatus, comprising the steps of:

(a) moving a first sheet in a second sheet path to an intersection with a first sheet path;

(b) moving the first sheet through the intersection and into the first sheet path;

(c) moving the first sheet in the first sheet path in a first direction to a first side of the intersection;

(d) again moving the first sheet in the first sheet path through the intersection;

(e) moving a second sheet in the second sheet path through the intersection as the first sheet again moves through the intersection on the first sheet path, wherein the first and second sheets are engaged in aligned relation to form a stack as the first and second sheets move through the intersection.

16. The method according to claim 15 and further comprising the steps of repeating step (d) with the stack and step (e) with a third sheet moving in the second transport path, whereby the third sheet is added to the stack.

17. The method according to claim 16 wherein prior to step (d):

the first sheet is moved in the first sheet path in an opposed direction to a second opposed side of the intersection; and wherein in steps (d) and (e) the engaged first and second sheets in the stack move in the first direction from the intersection.

18. The method according to claim 15 and further comprising the steps of:

(f) moving the stack in the first sheet path toward a user accessible area on the machine apparatus, whereby sheets passed into the user accessible area can be accessed by a user of the machine;

(g) moving the stack into the user accessible area.

19. The method according to claim 15 and further comprising the steps of:

(f) again moving the stack through the intersection;

(g) separating the second sheet from the stack as the stack moves through the intersection with a sheet directing device, wherein the second sheet is directed into the second sheet path.

20. An automated banking machine apparatus comprising:

an opening for delivering or receiving a stack of abutting sheets, wherein the opening comprises a user accessible opening, whereby the apparatus is enabled to deliver sheets to or receive sheets from a user through the opening;

a first transport wherein the first transport moves the documents to and from the opening along a first transport path;

a second transport wherein the second transport moves sheets on a second path, and wherein the second path intersects the first path at an intersection;

at least one sheet dispensing device in operative connection with at least one of the first path or the second path, the sheet dispensing device selectively dispensing sheets into the one path;

at least one sheet receiving device in operative connection with at least one of the first path or the second path, wherein the one sheet receiving device selectively receives sheets from the one path;

a sheet directing apparatus adjacent to the intersection, wherein the sheet directing apparatus is selectively operative as the stack moves through the intersection to either add a sheet from the second path to the stack or to separate a sheet from the stack and direct the separated sheet into the second path.

21. The apparatus according to claim 20 and further comprising a third transport wherein the third transport moves sheets along a third transport path, and wherein the third path intersects the first path at a second intersection disposed from the first intersection, and wherein a sheet in the third path is selectively added to the slack as the stack moves through the second intersection.

22. The apparatus according to claim 20 and further comprising a second opening, wherein a stack of sheets may be received or delivered through the second opening, the second opening positioned at an opposed end of the first transport path from the first opening, whereby the machine is enabled to deliver and receive stacks from users at each of the openings.

23. The apparatus according to claim 20 wherein the sheet directing apparatus comprises a member, wherein the member selectively applies frictional resistance to movement of a sheet bounding a side of the stack, whereby frictional resistance separates the sheet from the stack.

24. The apparatus according to claim 23 wherein the member has a selectively movable surface thereon, wherein when the stack moves through the intersection in a first direction and said movable member surface moves in an opposed direction relative to the stack, the sheet is separated from the stack, and wherein when the member surface moves in the first direction in generally coordinated relation with the stack, the sheet is not separated from the stack as the stack moves through the intersection.

25. The apparatus according to claim 20 wherein the sheet directing apparatus comprises a member having a movable member surface thereon, wherein when the stack moves in a first direction through the intersection, the movable member surface moves to guide a sheet moving in the second transport path into engaged relation with the stack.

26. The apparatus according to claim 25 and further comprising a first sensor sensing the stack in the first transport path, and a second sensor sensing the sheet in the second transport path, and control circuitry in operative connection with the first transport, the second transport, the first sensor and the second sensor, and wherein the control circuitry is operative to control the first and second transports to add the sheet to the stack as the stack moves through the intersection.

27. The apparatus according to claim 20 and further comprising a holding device in operative connection with the first path, the holding device being disposed away from the intersection, and wherein at least one sheet is selectively held in the holding device while at least one other sheet is moved through the intersection in the first path.

28. The apparatus according to claim 26 wherein the holding device is in the first sheet path between the opening and the intersection.

29. A method of operation of an automated banking machine apparatus comprising the steps of:

(a) moving a stack of sheets along a first sheet path, said stack including a first sheet bounding a side of the stack;

(b) moving the stack through an intersection of the first sheet path with a second sheet path;

(c) separating the first sheet from the stack as the stack moves through the intersection with a sheet directing device, wherein the first sheet is removed from the stack and is directed into the second sheet path.

30. The method according to claim 29 wherein a second sheet bounds the side of the stack after the first sheet has been separated therefrom, and further comprising the steps of:

(d) again, moving the stack through the intersection;

(e) separating the second sheet from the stack with the sheet directing device, wherein the second sheet is directed into the second sheet path.

31. The method according to claim 29 and either prior to or subsequent to step (c), further comprising the step of:

(f) passing the stack through the intersection without separating a sheet from the stack.

32. The method according to claim 29 and further comprising the steps of:

(d) dispensing a second sheet from a sheet dispensing device in the machine;

(e) moving the second sheet toward the intersection along the second sheet path;

(f) again moving the stack through the intersection;

(g) moving the second sheet through the intersection as the stack moves through the intersection along the first sheet path, wherein the second sheet is engaged with the stack in aligned relation as the stack and second sheet move through the intersection.

33. An automated banking machine apparatus comprising:

a transport, wherein the transport moves a stack of sheets along a first sheet path, the stack being bounded by a first sheet at a side of the stack;

a second sheet path intersecting the first sheet path at an intersection;

a sheet directing apparatus adjacent the intersection, the sheet directing apparatus being selectively operative to either separate the first sheet from the stack and direct it into the second sheet path as the stack moves through the intersection, or to enable the first sheet to pass through the intersection and to remain engaged with the stack;

a reversing drive in operative connection with the transport, wherein the drive is operative to repeatedly move the stack through the intersection.

34. The apparatus according to claim 1 and further comprising an imager, wherein the imager is in operative connection with the control circuitry and is operative to make an electronic image of sheets in an image sheet path, and further comprising a sensor operative to sense the first sheet, the sensor in operative connection with the control circuitry, wherein the control circuitry is operative to make a determination responsive to signals from the sensor as to whether the first sheet is of a first type, and wherein the control circuitry is operative responsive to the determination to route the sheet to the image sheet path.

35. The apparatus according to claim 33 wherein the transport is in operative connection with a sheet turnover device, and further comprising a holding device in operative connection with the transport, wherein the stack is enabled to be held in the holding device as the first sheet is turned over by the sheet turnover device.

36. The apparatus according to claim 33 wherein the transport moves either a stack of sheets or an envelope thereon, and further comprising a sensor adjacent to transport, the sensor in operative connection with control circuitry, wherein the control circuitry is operative responsive to signals from the sensor to make a determination of whether the stack or the envelope is in the transport, and wherein the control circuitry is operative to control the sheet directing apparatus responsive to the determination.

37. The apparatus according to claim 36 wherein the sheet directing apparatus is operative responsive to the determination that the envelope is moving in the transport to direct the envelope into a depository.

38. The apparatus according to claim 33 and further comprising a second transport moving a second sheet in the second sheet path toward the intersection, and control circuitry in operative connection with the transport and the second transport, wherein the control circuitry is operative to control movement of the stack in the transport and movement of the second sheet in the second transport to cause the second sheet to be added to the stack as the stack moves through the intersection.

39. The apparatus according to claim 3 and further comprising a sheet dispensing device in operative connection with the control circuitry, wherein the sheet dispensing device is operative to selectively deliver a dispensed sheet to the second transport, and wherein the control circuitry is operative to control the transport and second transport to add the dispensed sheet to the stack as the stack moves through the intersection.

40. The apparatus according to claim 39 and further comprising a printer in operative connection with the control circuitry, and wherein the printer is selectively operative to print on sheets positioned in a printer sheet path, and wherein the printer sheet path is in operative connection with the second sheet path, and wherein the control circuitry is operative to route a dispensed sheet to the printer sheet path and to cause printing to be conducted thereon prior to adding the dispensed sheet to the first sheet path.

41. The apparatus according to claim 39 and further comprising a third sheet path intersecting with the first sheet path at a second intersection disposed from the first intersection, and a third transport moving sheets in the third sheet path, the third transport in operative connection with the control circuitry, and further comprising a second sheet dispensing device in operative connection with the control circuitry, wherein the second sheet dispensing device is operative to selectively deliver a second dispensed sheet to the third transport, and wherein the control circuitry is operative to control the transport and third transport to add the second dispensed sheet to the stack as the stack moves through the second intersection.

42. The apparatus according to claim 41 wherein the dispensed sheet is added to the first side of the stack and the second dispensed sheet is added to an opposed side of the stack.

43. An automated banking machine apparatus comprising:

a transport, wherein the transport moves a stack of sheets along a first sheet path, the stack being bounded by a first sheet at a side of the stack;

a second sheet path intersecting the first sheet path at an intersection;

a sheet directing apparatus adjacent the intersection, the sheet directing apparatus being selectively operative to either separate the first sheet from the stack and direct it into the second sheet path as the stack moves through the intersection, or to enable the first sheet to pass through the intersection and to remain engaged with the stack;

a sheet turnover device and a holding device, wherein the stack is enabled to be held in the holding device as the first sheet is turned over by the sheet turnover device.

44. The apparatus according to claim 33 operative connection with the transport, wherein the drive is operative to repeatedly move the stack through the intersection, wherein sheets bounding the side of the stack are selectively separated from the stack and directed into the second sheet path as the stack is moved through the intersection.

* * * * *